US011131116B2

(12) United States Patent
Ward et al.

(10) Patent No.: US 11,131,116 B2
(45) Date of Patent: Sep. 28, 2021

(54) GATE-LATCHING ASSEMBLY

(71) Applicants: Timothy Patrick Ward, Aurora (CA); Douglas Arnold Selwood, Newmarket (CA)

(72) Inventors: Timothy Patrick Ward, Aurora (CA); Douglas Arnold Selwood, Newmarket (CA)

( * ) Notice: Subject to any disclaimer, the term of this patent is extended or adjusted under 35 U.S.C. 154(b) by 796 days.

(21) Appl. No.: 15/821,288

(22) Filed: Nov. 22, 2017

(65) Prior Publication Data

US 2019/0153747 A1 May 23, 2019

(51) Int. Cl.

| | |
|---|---|
| ***E05B 65/00*** | (2006.01) |
| ***E05B 15/02*** | (2006.01) |
| ***E05C 3/08*** | (2006.01) |
| *E05C 3/12* | (2006.01) |
| *E05C 3/04* | (2006.01) |

(52) U.S. Cl.

CPC ..... *E05B 15/0245* (2013.01); *E05B 15/025* (2013.01); *E05B 65/0007* (2013.01); *E05C 3/08* (2013.01); *E05C 3/046* (2013.01); *E05C 2003/126* (2013.01)

(58) Field of Classification Search

CPC .... Y10S 292/29; Y10S 292/53; Y10S 292/54; Y10S 292/60; Y10T 292/1063; Y10T 292/1064; Y10T 292/1072; Y10T 292/696; Y10T 292/705; Y10T 292/707; E05B 65/0007; E05B 15/024; E05B 15/0245; E05B 15/025

See application file for complete search history.

(56) References Cited

U.S. PATENT DOCUMENTS 58,929 A * 10/1866 Wood ..... E05B 15/0245 292/341.19
86,217 A * 1/1869 Davis ..... E05C 1/004 292/341.19

(Continued)

FOREIGN PATENT DOCUMENTS

CA 1046552 * 1/1979
CA 2095989 A1 * 11/1994 ..... E05B 65/0007

(Continued)

OTHER PUBLICATIONS

Self Aligning Gate Latch, retrieved from "http://www.leevalley.com/US/hardware/page.aspx?p=47817&cat=3,41399,48019" on Aug. 18, 2017.

(Continued)

*Primary Examiner* — Carlos Lugo

(57) ABSTRACT

A gate-latching assembly is configured for utilization with a gate assembly. The gate assembly includes a stationary gate post configured to be mounted to, and to extend from, a working surface once the stationary gate post is mounted to the working surface, and in which the gate assembly also includes a movable gate door configured to be movable relative to the stationary gate post. There is provided a combination for utilization with the gate assembly. The combination includes any one of (A) a striker base assembly and a striker member, (B) a latch base assembly and a latch assembly, and/or (C) a striker base assembly, a striker member, a latch base assembly and a latch assembly.

12 Claims, 17 Drawing Sheets

(56) References Cited

U.S. PATENT DOCUMENTS 126,191 A * 4/1872 Dickey ..... E05F 11/00 292/238
148,662 A * 3/1874 Burr ..... E05B 15/0245 292/341.19
275,262 A 4/1883 Pettis
277,807 A * 5/1883 Stovall ..... E05B 65/0811 292/128
394,685 A * 12/1888 Fether ..... E05B 65/0007 292/210
411,955 A * 10/1889 Ellis ..... E05C 3/30 292/127
474,021 A * 5/1892 Linindoll ..... E05C 19/08 292/281
533,363 A * 1/1895 Little ..... E05B 15/0245 292/341.19
931,163 A 8/1909 Varnell
1,024,603 A * 4/1912 Schmidgall ..... E05B 63/127 70/114
1,326,554 A 12/1919 Watson
1,537,703 A * 5/1925 Adolph ..... E05B 15/0245 292/341.18
1,614,046 A * 1/1927 Schmidgall ..... E05B 15/0245 292/341.18
2,275,760 A * 3/1942 Hoffman ..... E05C 19/08 292/281
2,683,049 A * 7/1954 Van Der Spek ..... E05C 3/044 292/207
2,794,663 A 6/1957 Grodt et al.
3,266,831 A * 8/1966 Banse ..... E05C 3/24 292/133
3,955,837 A 5/1976 Christensen
4,124,954 A 11/1978 Redick
4,305,611 A * 12/1981 Robins ..... E05B 63/0056 292/1
5,498,041 A 3/1996 Bezzerides et al.
5,868,446 A * 2/1999 Rossmo ..... E05B 15/0006 292/122
6,422,613 B1 7/2002 Boroviak
6,679,530 B2 1/2004 Krynski
6,752,438 B2 * 6/2004 DeSouza ..... E05B 65/0007 16/235
7,325,842 B1 2/2008 Lenz
7,744,135 B2 * 6/2010 Wiese ..... E05B 85/045 292/341.15
7,883,124 B2 2/2011 Gephart et al.
8,308,205 B2 11/2012 Tejszerski
8,382,171 B2 * 2/2013 Williams ..... E05B 15/024 292/341
8,733,807 B2 * 5/2014 Williams ..... E05B 85/045 292/341.15
9,109,377 B1 * 8/2015 Guttery ..... E05B 15/024
9,140,039 B1 * 9/2015 Krishnan ..... E05B 85/045
9,297,183 B2 * 3/2016 Williams ..... E05B 15/024
10,000,944 B2 * 6/2018 Cavallaro, Jr. ..... E05B 15/0205
2009/0108591 A1 * 4/2009 De Vries ..... E05B 15/0245 292/64
2010/0156119 A1 * 6/2010 Mueller ..... E05B 15/0205 292/126
2012/0146344 A1 * 6/2012 Markou ..... E05B 65/0007 292/161
2017/0122004 A1 5/2017 Calamia
2017/0152682 A1 * 6/2017 Mizner ..... E05C 3/06

FOREIGN PATENT DOCUMENTS

CA 2454213 A1 * 6/2005 ..... E05B 65/0007
FR 2486578 A1 * 1/1982 ..... E05B 15/025

OTHER PUBLICATIONS

V1131 Sliding Bolt Door/Gate Latches, retrieved from "http://ca.natman.com/detail/v1131-sliding-bolt-door-gate-latches-stainless-steel-342-659" on Aug. 15, 2017.

* cited by examiner

GATE-LATCHING ASSEMBLY

TECHNICAL FIELD

This document relates to the technical field of (and is not limited to) a gate-latching assembly configured for utilization with a gate assembly (and method therefor); more specifically, this document relates to the technical field of (and is not limited to) a combination for utilization with a gate assembly, in which the combination includes any one of (A) a striker base assembly and a striker member, (B) a latch base assembly and a latch assembly, and/or (C) a striker base assembly, a striker member, a latch base assembly and a latch assembly (and method therefor).

BACKGROUND

A gate is a point of entry to a space which is enclosed by walls. Gates may prevent or control the entry or exit of individuals, and may refer to the gap in the wall or fence, rather than the barrier which closes the space. The moving part or parts of a gateway may be called a door. A gate may have a latch to keep the gate from swinging, and may also include a lock for security. A latch or catch is a type of mechanical fastener that joins two (or more) objects or surfaces while allowing for their regular separation. A latch typically engages another piece of hardware on the other mounting surface. Depending upon the type and design of the latch, this engaged bit of hardware may be known as a keeper or strike (striker).

SUMMARY

It will be appreciated that there exists a need to mitigate (at least in part) at least one problem associated with the existing gate-latching assemblies (also called the existing technology). After much study of the known systems and methods with experimentation, an understanding (at least in part) of the problem and its solution have been identified (at least in part) and are articulated (at least in part) as follows:

Frost heaving (frost heave, frost heaving, etc.), which is a force that moves, raises, or lifts the ground) is an upwards swelling of soil during freezing conditions caused by an increasing presence of ice as the ice grows (forms) towards the surface, upwards from the depth in the soil where freezing temperatures have penetrated into the soil (the freezing front or freezing boundary). Ice growth requires a water supply that delivers water to the freezing front via capillary action in certain soils. The weight of overlying soil restrains vertical growth of the ice and can promote the formation of lens-shaped areas of ice within the soil. Yet, the force of one or more growing ice lenses is sufficient to lift a layer of soil (such as, as much as about one foot or more). Such soil is referred to as frost susceptible.

For the case where the outdoor temperature changes (such as, during the changing of seasons from fall to winter or from winter to spring), the components of a gate assembly may become inadvertently shifted as a result of frost heave. More specifically, frost heaving may inadvertently urge unwanted shifting of the components of the gate assembly, such as the inadvertent movement of a stationary gate post (the stationary gate post is configured to be mounted to, and to extend from, a working surface or the ground). The gate assembly also includes a movable gate door configured to be movable relative to the stationary gate post. For the case where frost heaving inadvertently urges unwanted shifting of the stationary gate post, the stationary gate post and the movable gate door become misaligned relative to each other. Moreover, the components of a gate latch device may not be able to securely latch the gate assembly once the stationary gate post and the movable gate door become vertically misaligned relative to each other (as a result of frost heave acting on the stationary gate post).

To mitigate, at least in part, at least one problem associated with the existing technology, there is provided (in accordance with a major aspect) an apparatus.

The apparatus includes a gate-latching assembly having a striker member configured to be selectively vertically moveable from a first vertical position to a second vertical position. In the first vertical position, the striker member and the latch assembly are misaligned relative to each other as a result of the stationary gate post and the movable gate door becoming misaligned relative to each other. In the second vertical position, the striker member and the latch assembly are aligned relative to each other). This is done in such a way that: (A) the striker member, in use, remains horizontally aligned while the striker member is moved from the first vertical position to the second vertical position, and (B) the striker member and the latch assembly, in use, are securely latchable with each other in the second vertical position once the stationary gate post and the movable gate door are vertically misaligned relative to each other.

To mitigate, at least in part, at least one problem associated with the existing technology, there is provided (in accordance with a major aspect) an apparatus. The apparatus includes and is not limited to (comprises) a gate-latching assembly configured for utilization with a gate assembly. The gate assembly includes a stationary gate post configured to be mounted to, and to extend from, a working surface once the stationary gate post is mounted to the working surface. The gate assembly also includes a movable gate door configured to be movable relative to the stationary gate post.

In accordance with a preferred embodiment, the gate-latching assembly includes a striker base assembly configured to be affixed to the gate assembly. This is done in such a way that the striker base assembly, in use, is spaced apart from a latch assembly once the latch assembly is affixed to the gate assembly, and once the striker base assembly is affixed to the gate assembly (in which the latch assembly is configured to be affixed to the gate assembly).

In accordance with a preferred embodiment, the gate-latching assembly also includes a striker member configured to be selectively affixed to the striker base assembly. This is done in such a way that the striker member, in use, is securely positioned and aligned along a horizontal alignment once the striker base assembly is affixed to the gate assembly, and once the striker member is affixed to the striker base assembly.

In accordance with a preferred embodiment, the striker member is also configured to be selectively engageable with, and selectively disengageable from, the latch assembly once the striker member is affixed to the striker base assembly, and once the striker base assembly is affixed to the gate assembly, and once the latch assembly is affixed to the gate assembly.

In accordance with a preferred embodiment, the striker member is also configured to be selectively affixed to and selectively disconnected (selectively disconnectable) from a first vertical position located on the striker base assembly and/or a second vertical position located on the striker base assembly.

In accordance with a preferred embodiment, the striker member is also configured to be selectively vertically moveable along a vertical length of the striker base assembly from the first vertical position located on the striker base assembly to the second vertical position located on the striker base assembly once the striker member is disconnected from the first vertical position in such a way that the striker member, in use, remains horizontally aligned while the striker member is selectively vertically moveable along the vertical length of the striker base assembly from the first vertical position to the second vertical position.

In accordance with a preferred embodiment, the striker member is also configured to be selectively vertically moveable from a first vertical position (in which the striker member and the latch assembly are misaligned relative to each other as a result of the stationary gate post and the movable gate door becoming misaligned relative to each other) to a second vertical position (in which the striker member and the latch assembly are aligned relative to each other).

This is done in such a way that: (A) the striker member, in use, remains horizontally aligned while the striker member is moved from the first vertical position to the second vertical position, and (B) the striker member and the latch assembly, in use, are securely latchable with each other in the second vertical position once the stationary gate post and the movable gate door are vertically misaligned relative to each other.

To mitigate, at least in part, at least one problem associated with the existing technology, there is provided (in accordance with a major aspect) an apparatus. The apparatus includes a gate-latching assembly having a latch assembly configured to be selectively vertically moveable from a first vertical position (in which the latch assembly and the striker member are misaligned relative to each other as a result of the stationary gate post and the movable gate door becoming misaligned relative to each other) to a second vertical position (in which the latch assembly and the striker member are aligned relative to each other). This is done in such a way that: (A) the latch assembly, in use, remains horizontally aligned while the latch assembly is moved from the first vertical position to the second vertical position, and (B) the latch assembly and the striker member, in use, are securely latchable with each other in the second vertical position once the stationary gate post and the movable gate door are vertically misaligned relative to each other.

To mitigate, at least in part, at least one problem associated with the existing technology, there is provided (in accordance with a major aspect) an apparatus. The apparatus includes and is not limited to (comprises) a gate-latching assembly configured for utilization with a gate assembly. The gate assembly includes a stationary gate post configured to be mounted to, and to extend from, a working surface once the stationary gate post is mounted to the working surface. The gate assembly also includes a movable gate door configured to be movable relative to the stationary gate post. The gate-latching assembly includes a latch base assembly configured to be affixed to the gate assembly. This is done in such a way that the latch base assembly, in use, is spaced apart from a striker base assembly once the striker base assembly is affixed to the gate assembly, and once the latch base assembly is affixed to the gate assembly, and in which the striker base assembly is configured to be affixed to the gate assembly, and in which a striker member is configured to be affixed to the striker base assembly in such a way that the striker member, in use, is securely positioned and aligned along a horizontal alignment once the striker base assembly is affixed to the gate assembly, and once the striker member is affixed to the striker base assembly. The gate-latching assembly also includes a latch assembly configured to be affixed to the latch base assembly.

In accordance with a preferred embodiment, the latch assembly is also configured to be selectively engageable with, and selectively disengageable from, the striker member once the latch assembly is affixed to the latch base assembly, and once the striker base assembly is affixed to the gate assembly, and once the latch base assembly is affixed to the gate assembly.

In accordance with a preferred embodiment, the latch assembly is also configured to be selectively affixed to and selectively disconnected (selectively disconnectable) from a first position (one position) located on the latch base assembly and/or a second position (another position) located on the latch base assembly.

In accordance with a preferred embodiment, the latch assembly is also configured to be selectively vertically moveable from a first vertical position (in which the latch assembly and the striker member are misaligned relative to each other as a result of the stationary gate post and the movable gate door becoming misaligned relative to each other) to a second vertical position (in which the latch assembly and the striker member are aligned relative to each other).

This is done in such a way that: (A) the latch assembly, in use, remains horizontally aligned while the latch assembly is moved from the first vertical position to the second vertical position, and (B) the latch assembly and the striker member, in use, are securely latchable with each other in the second vertical position once the stationary gate post and the movable gate door are vertically misaligned relative to each other.

Other aspects are identified in the claims. Other aspects and features of the non-limiting embodiments may now become apparent to those skilled in the art upon review of the following detailed description of the non-limiting embodiments with the accompanying drawings. This Summary is provided to introduce concepts in simplified form that are further described below in the Detailed Description. This Summary is not intended to identify key features or essential features of the disclosed subject matter, and is not intended to describe each disclosed embodiment or every implementation of the disclosed subject matter. Many other novel advantages, features, and relationships will become apparent as this description proceeds. The figures and the description that follow more particularly exemplify illustrative embodiments.

BRIEF DESCRIPTION OF THE DRAWINGS

The non-limiting embodiments may be more fully appreciated by reference to the following detailed description of the non-limiting embodiments when taken in conjunction with the accompanying drawings, in which.

Figure 1:
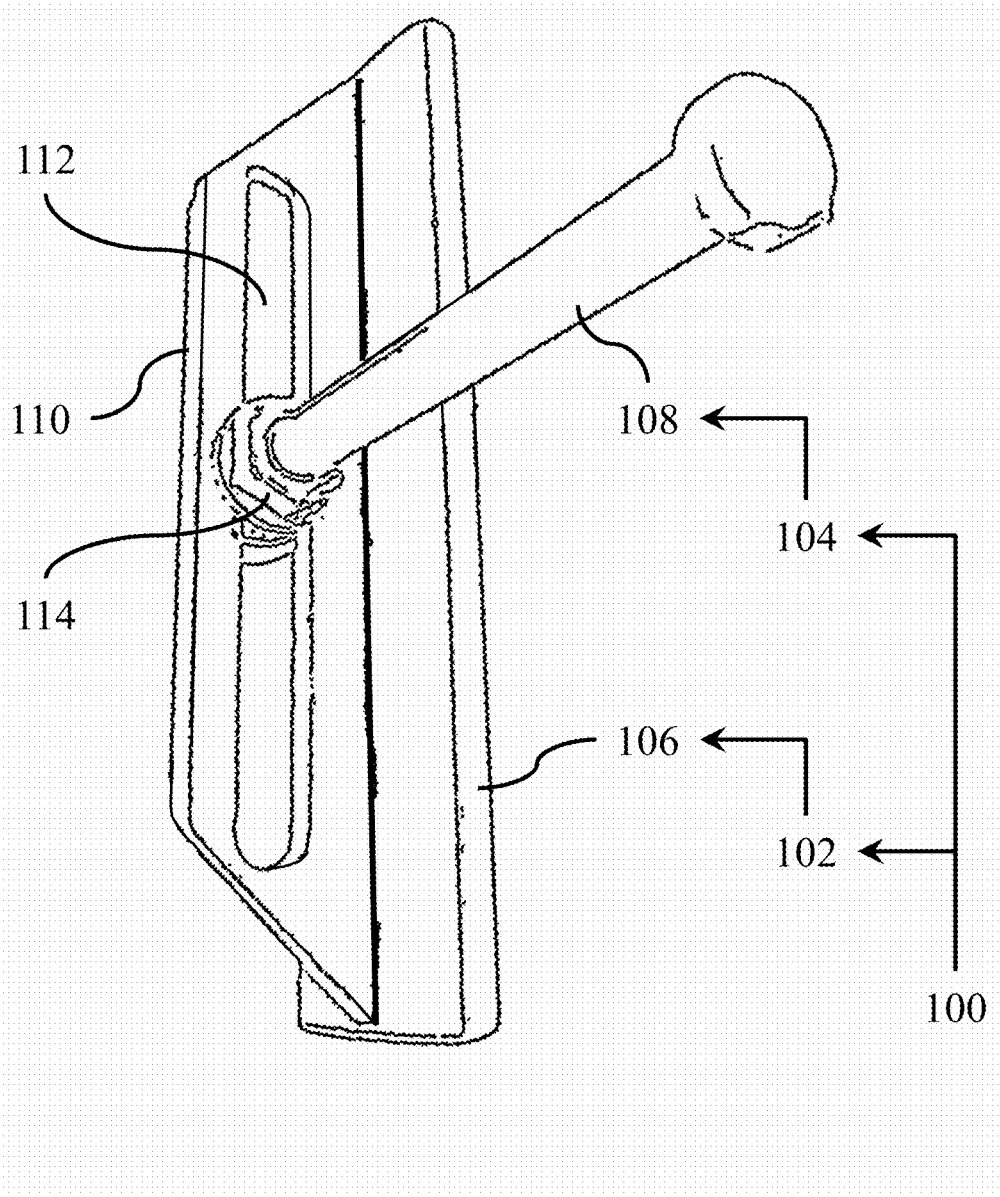
FIG. 1 to FIG. 23 depict, in accordance with a first major aspect, views of embodiments of a striker base assembly and a striker member.
Figure 2:
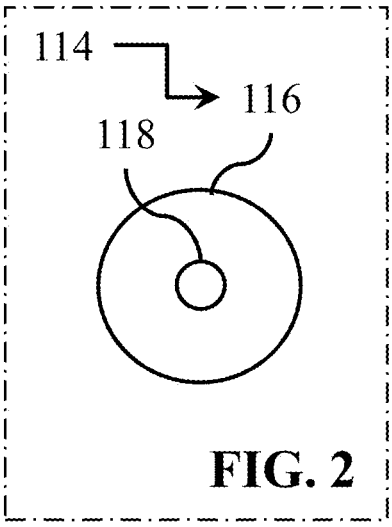
Figure 3:
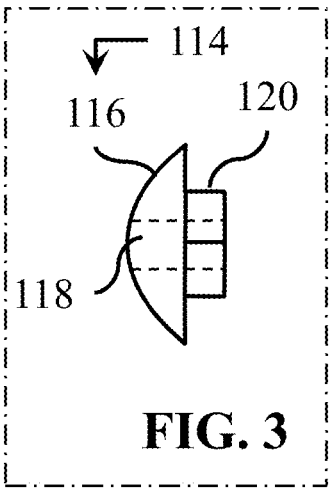
Figure 4:
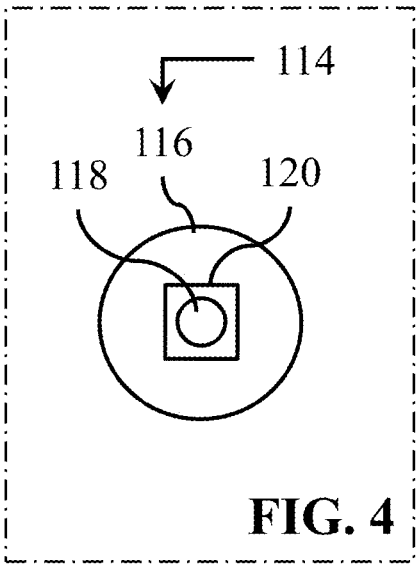
Figure 5:
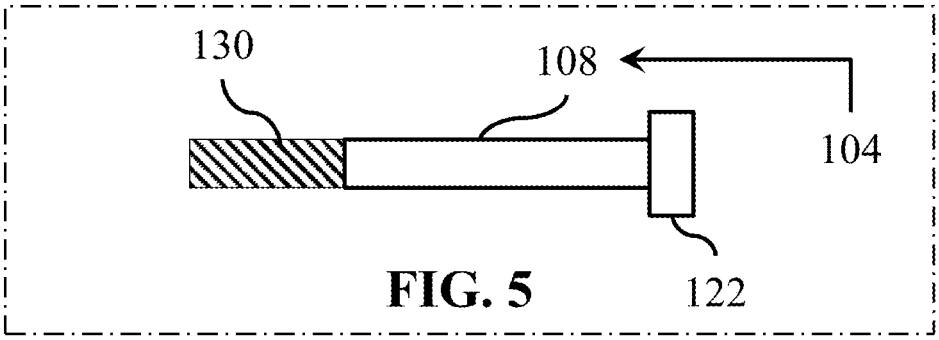
Figure 6:
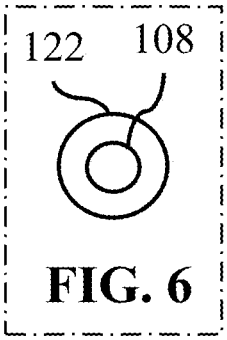
Figure 7:
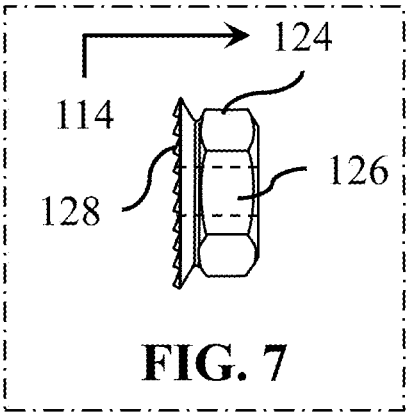
Figure 8:
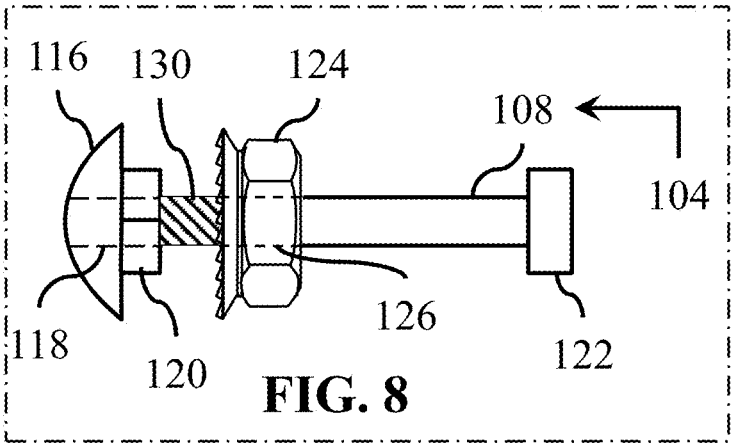
Figure 9:
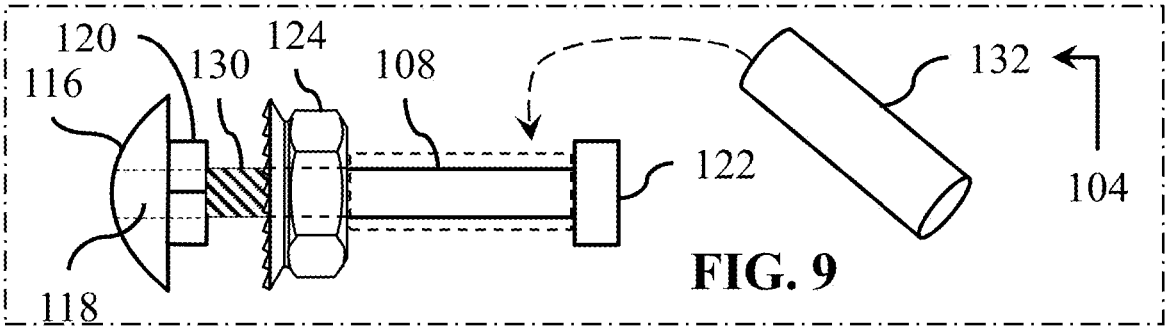
Figure 10:
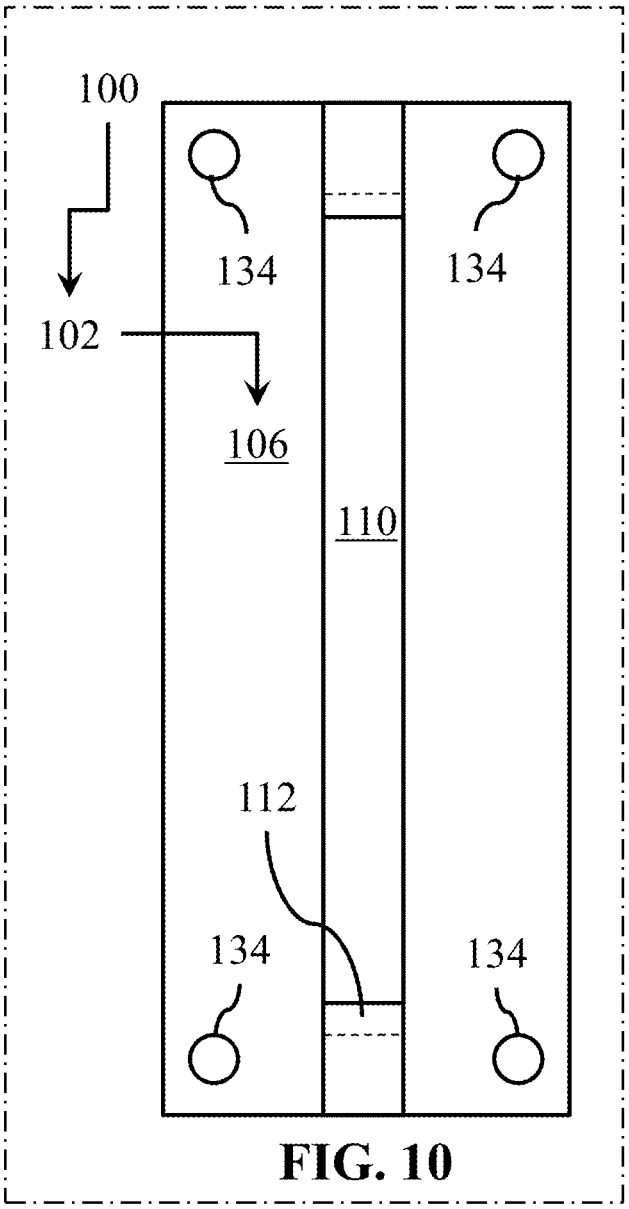
Figure 11:
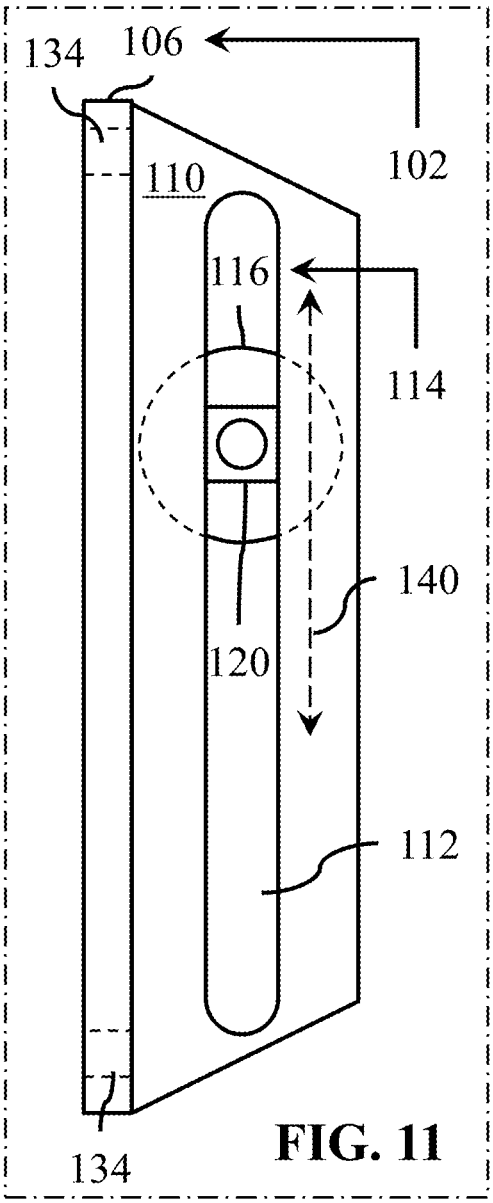
Figure 12:
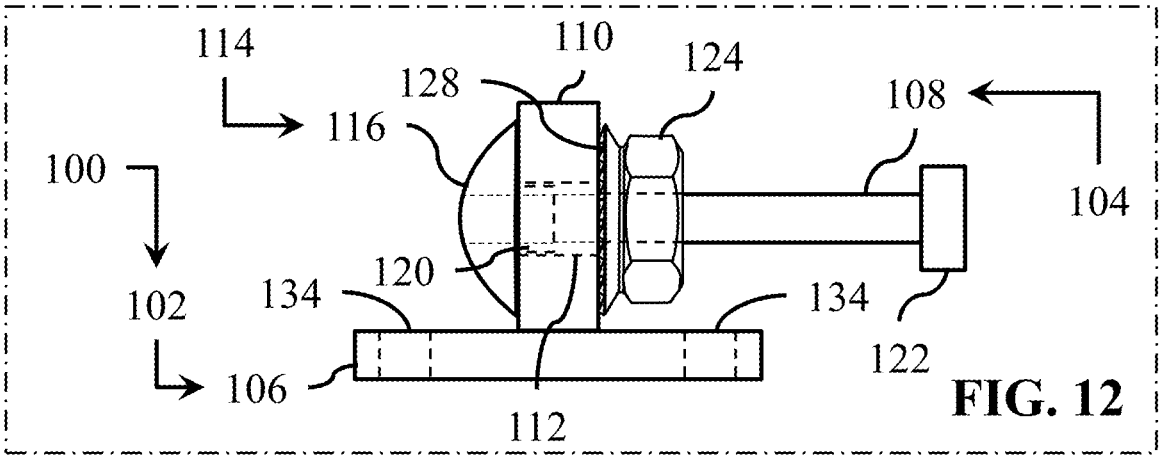
Figure 13:
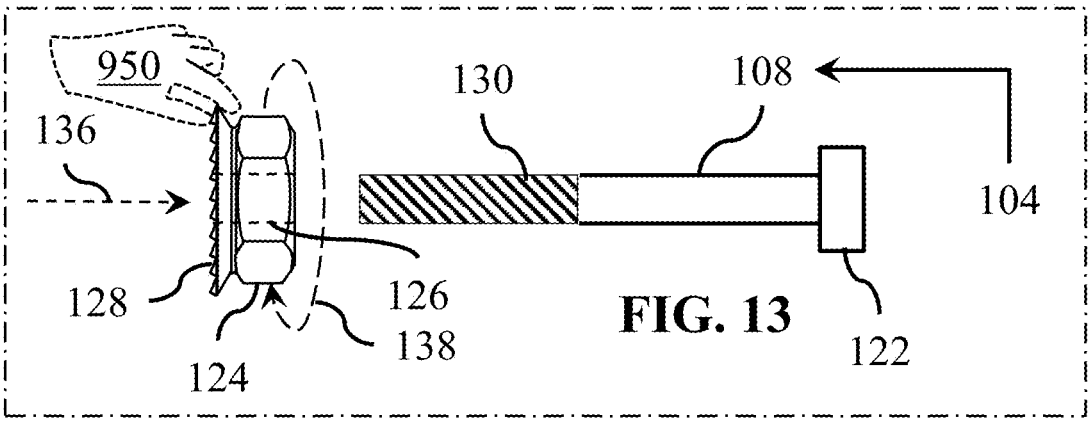
Figure 14:
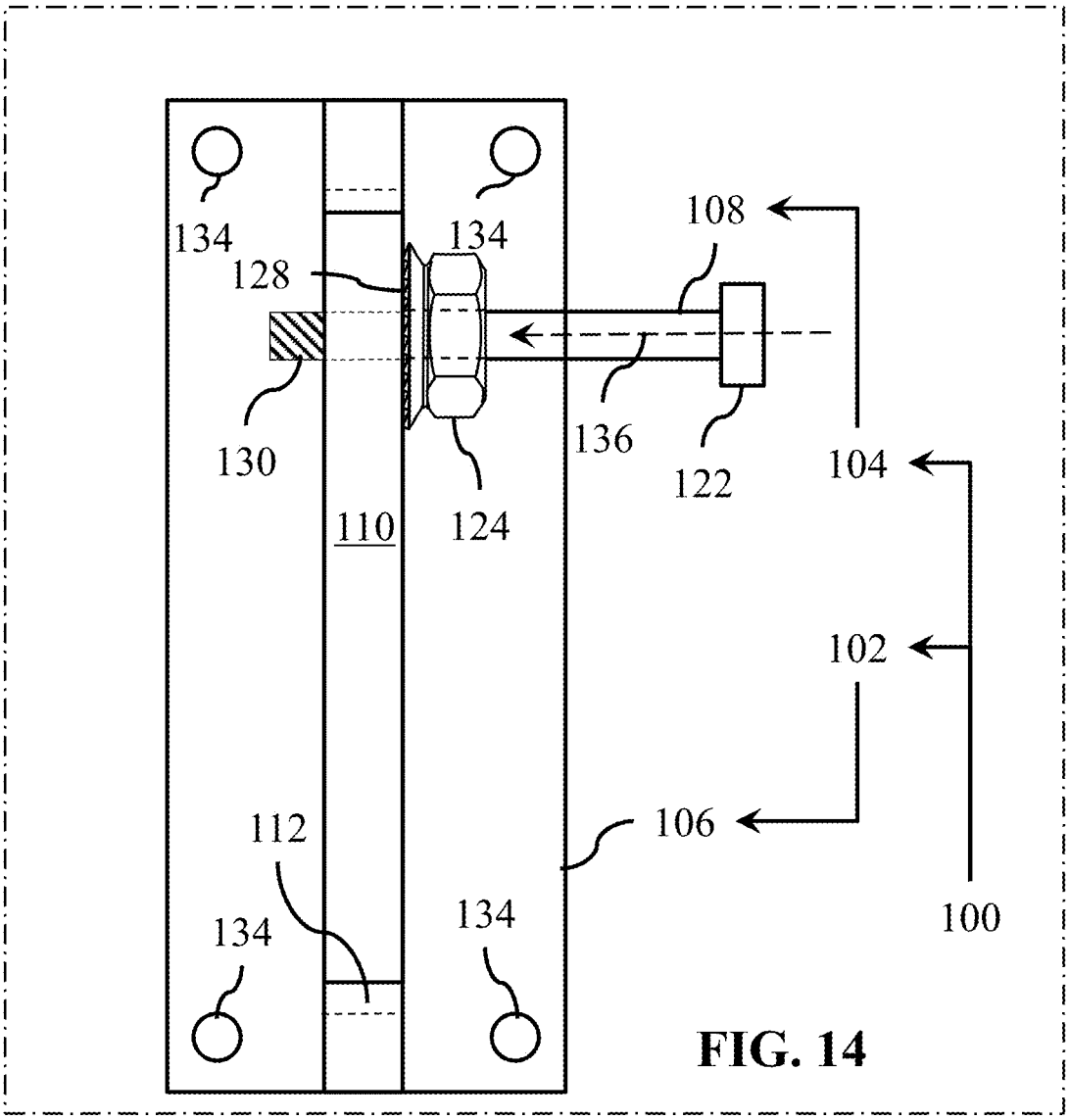
Figure 15:
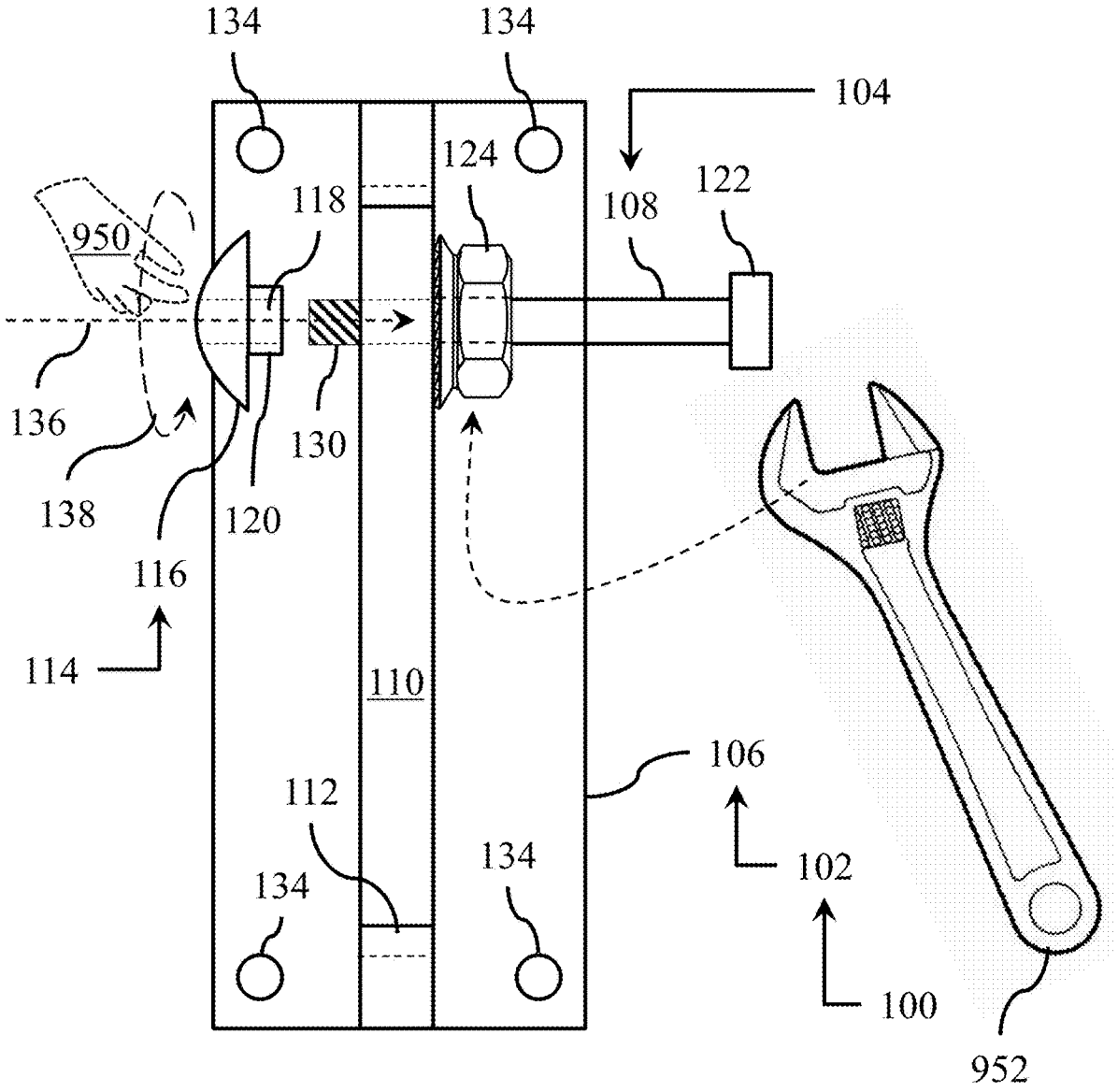
Figure 16A:
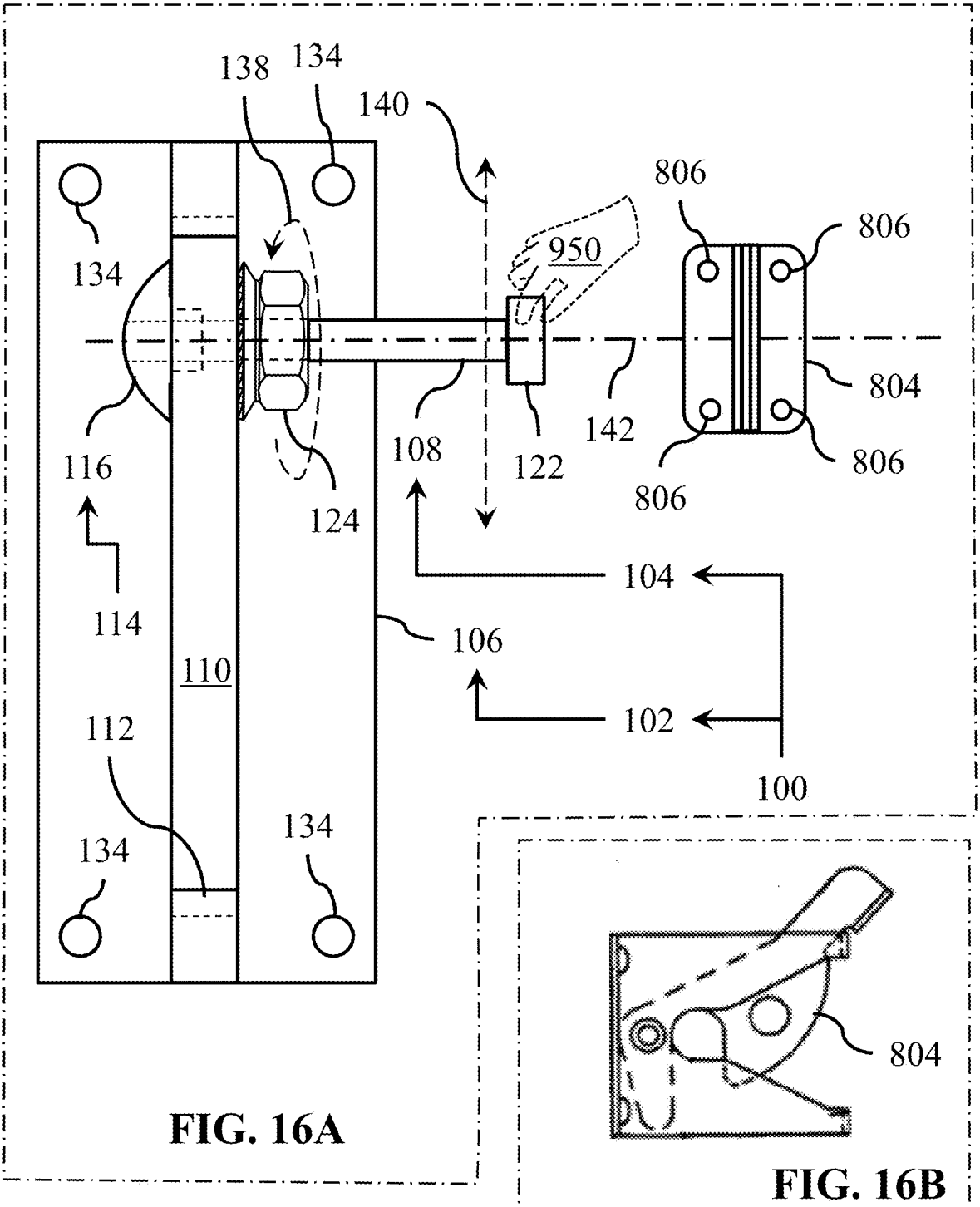
Figure 16B:
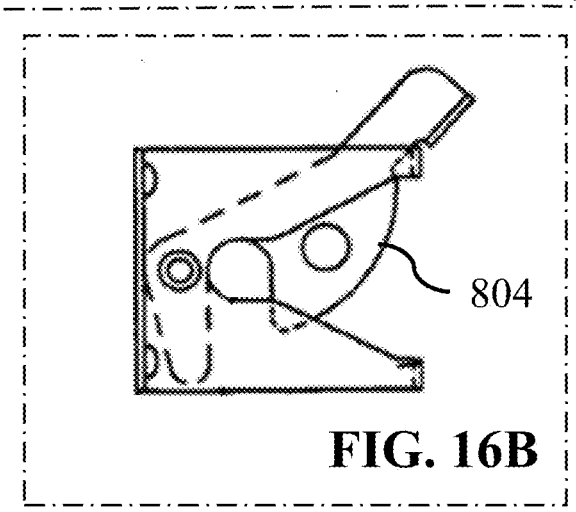
Figure 17:
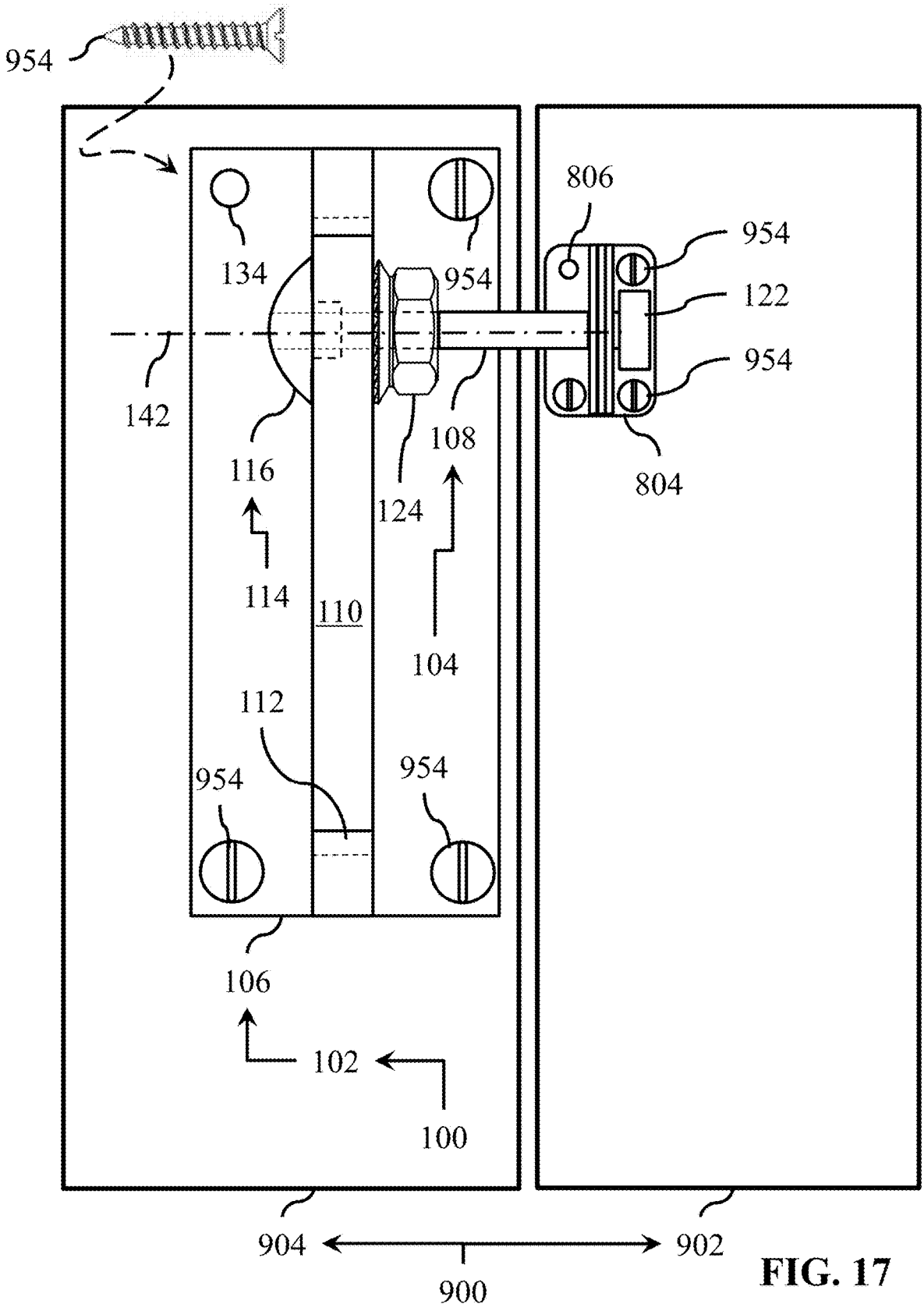
Figure 18:
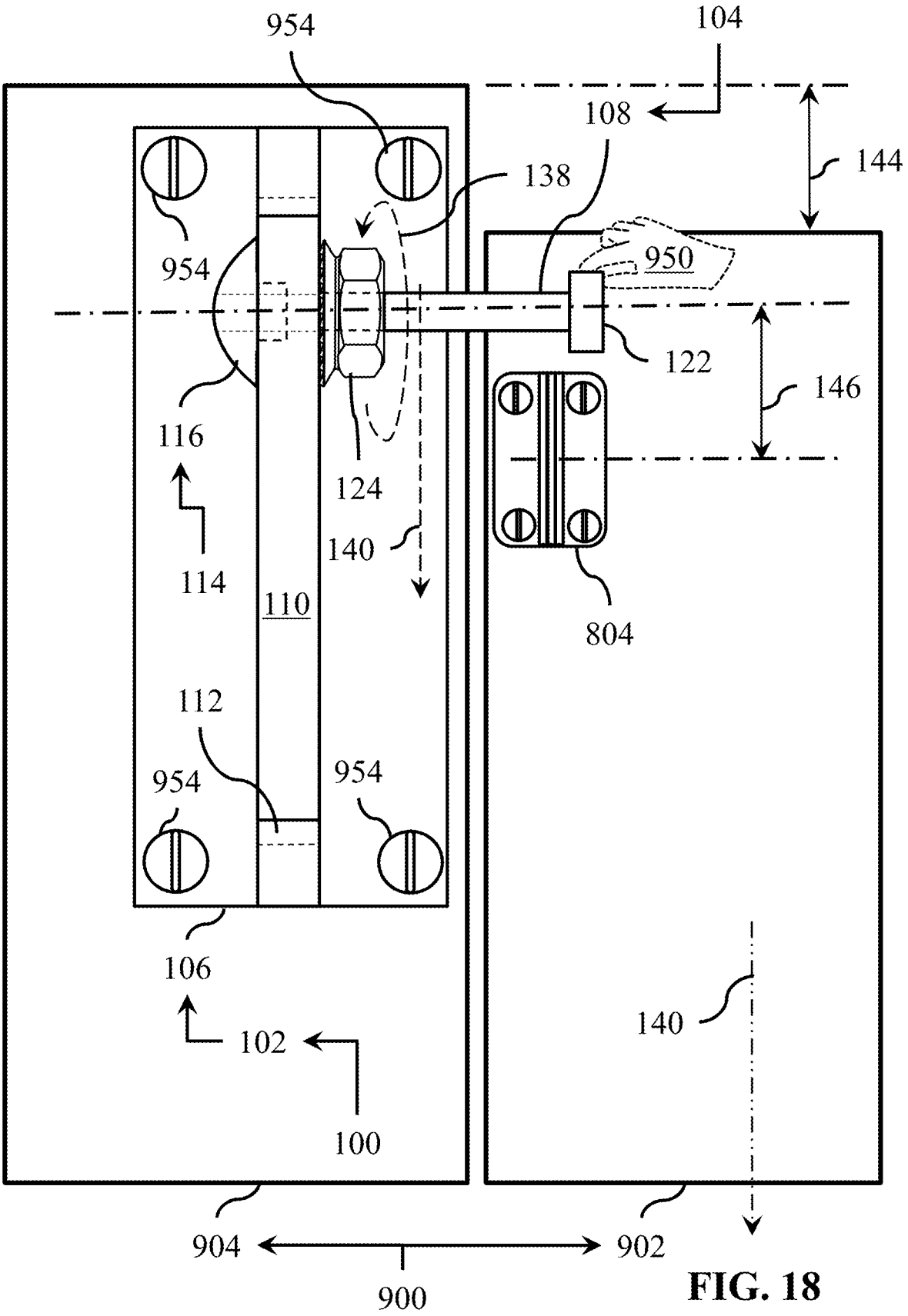
Figure 19:
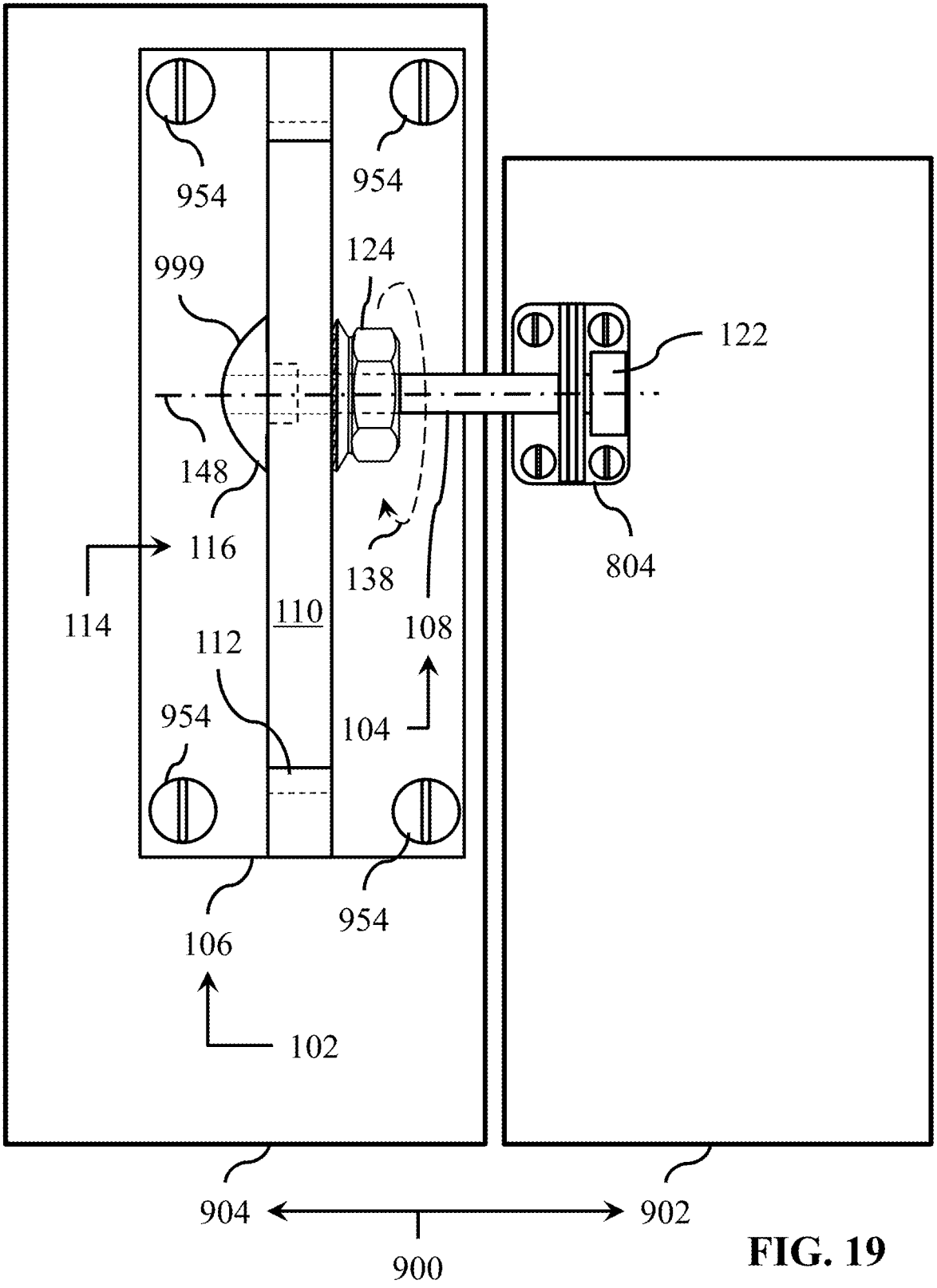
Figure 20:
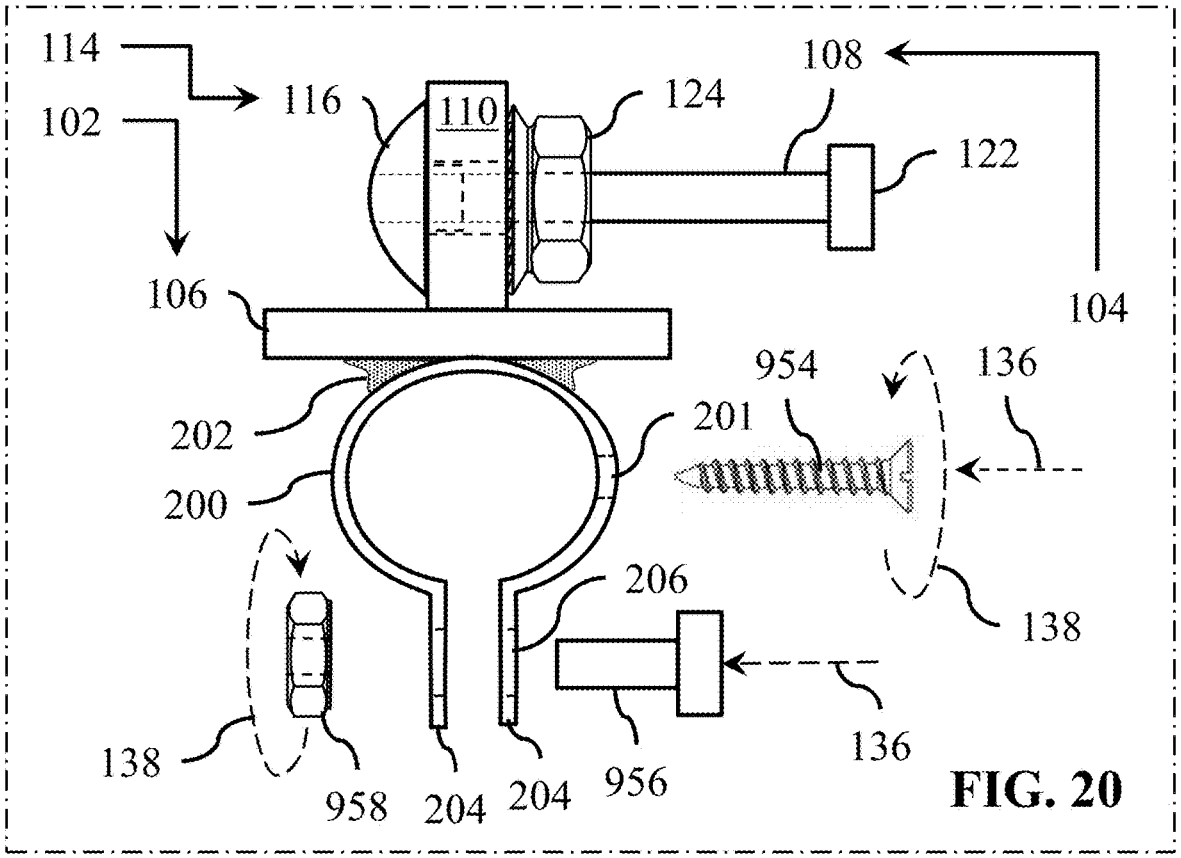
Figure 21:
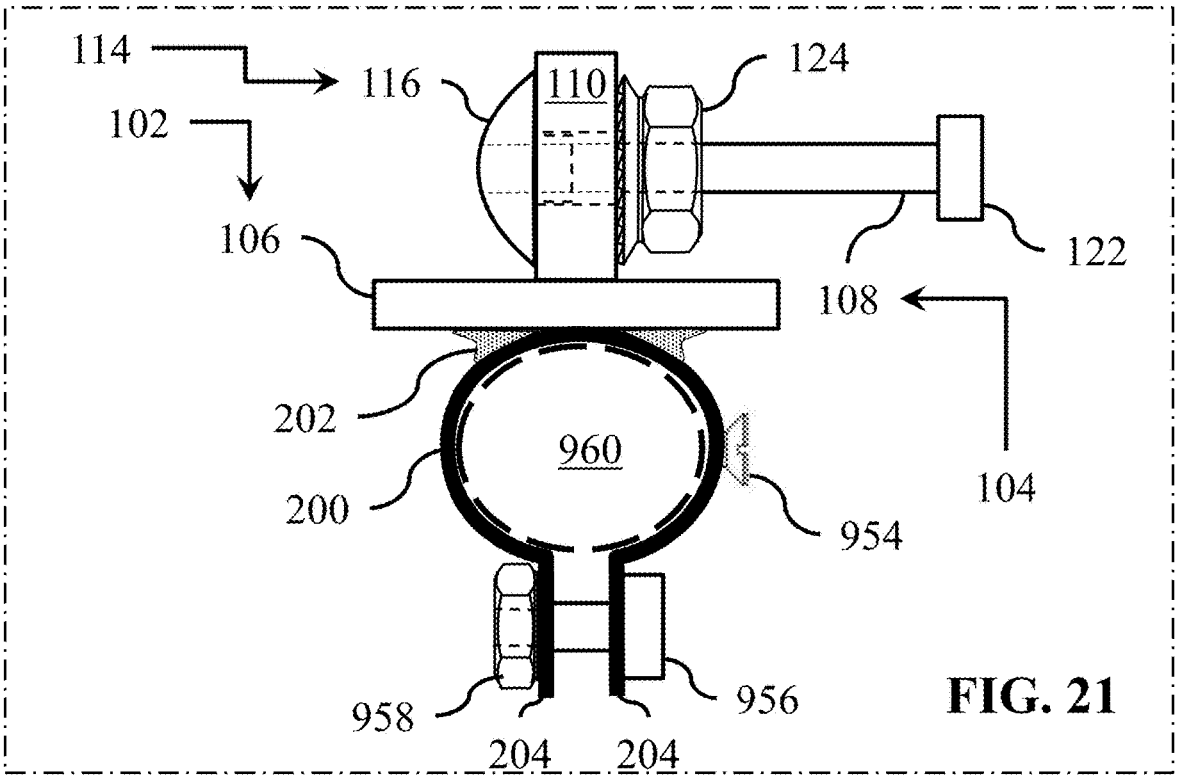
Figure 22:
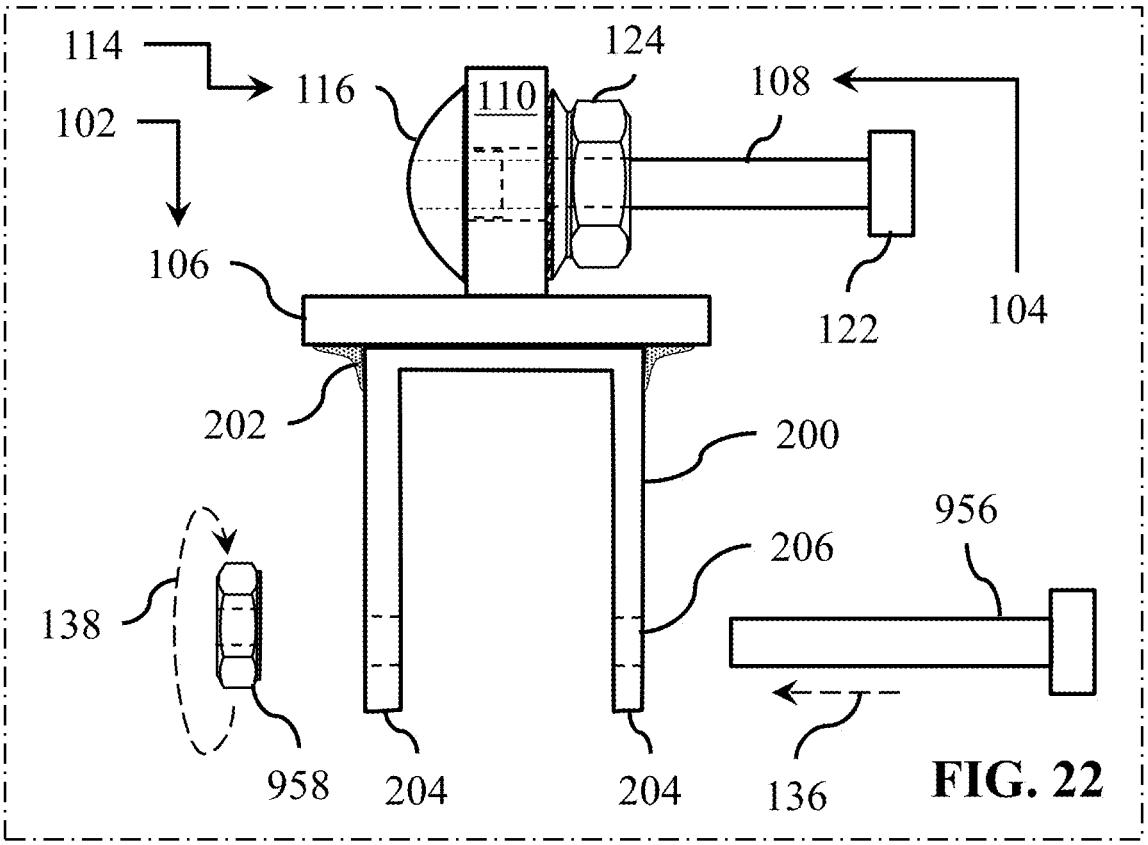
Figure 23:
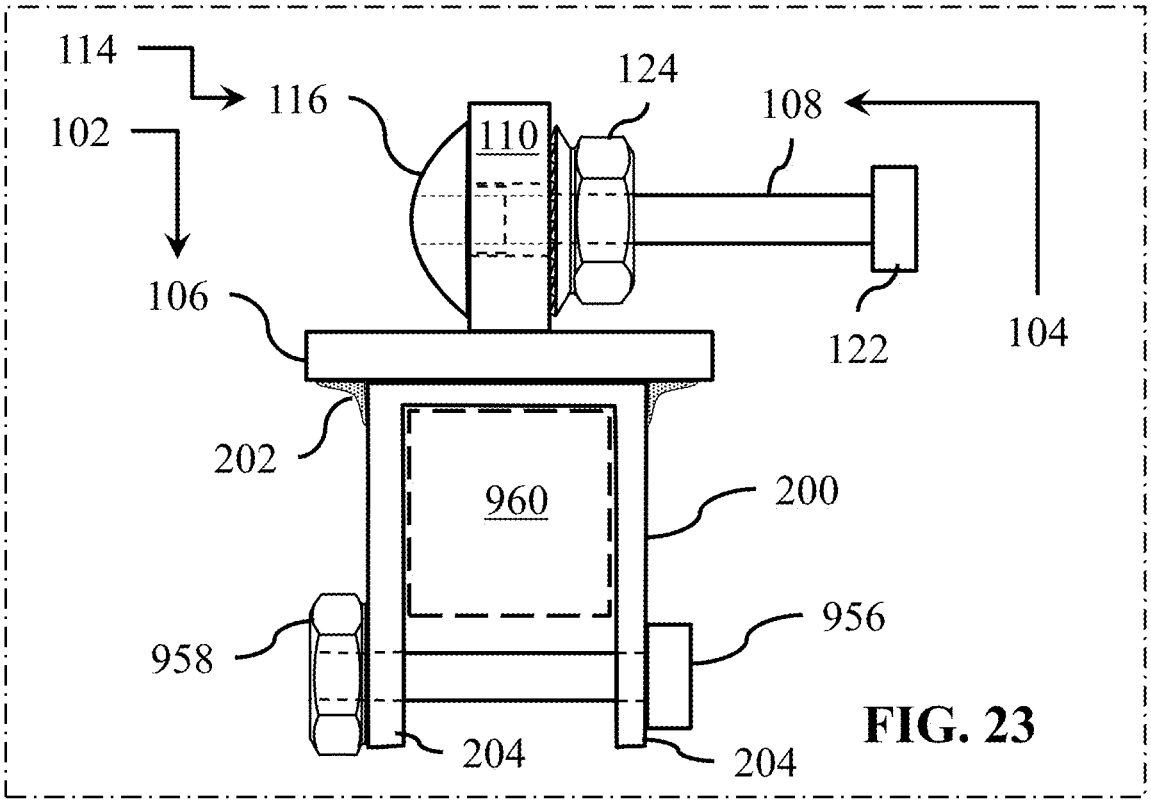
Figure 24:
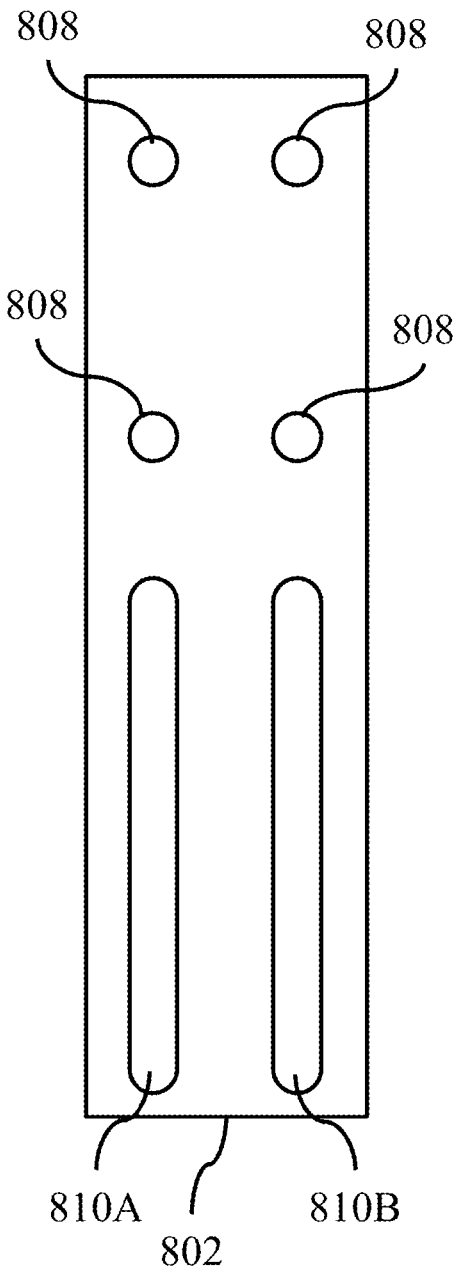
FIG. 24 to FIG. 31 depict, in accordance with a second major aspect, views of embodiments of a latch base assembly and a latch assembly.
Figure 25:
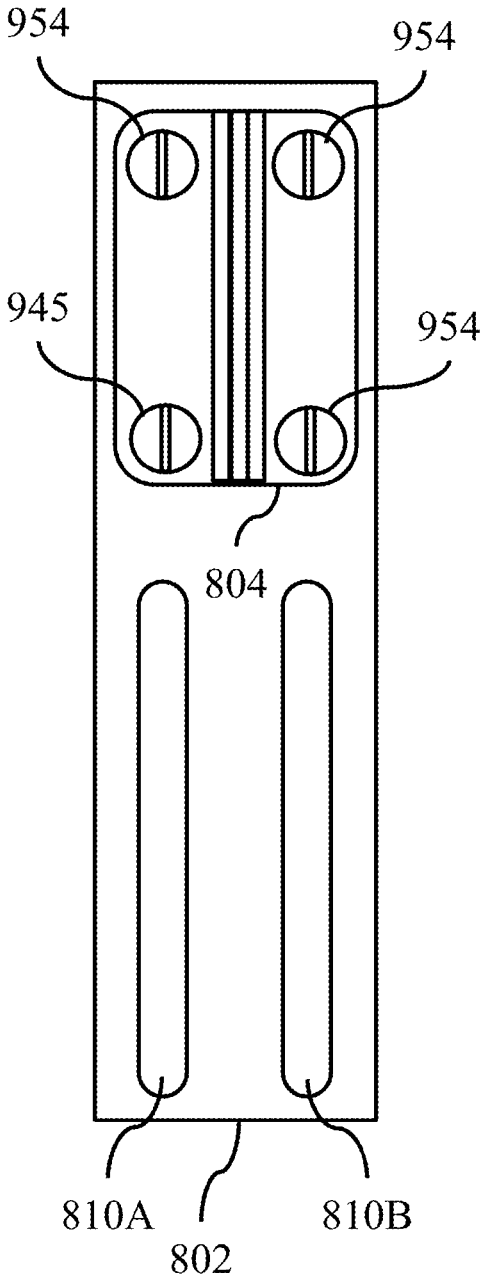
Figures 26A, 26B:
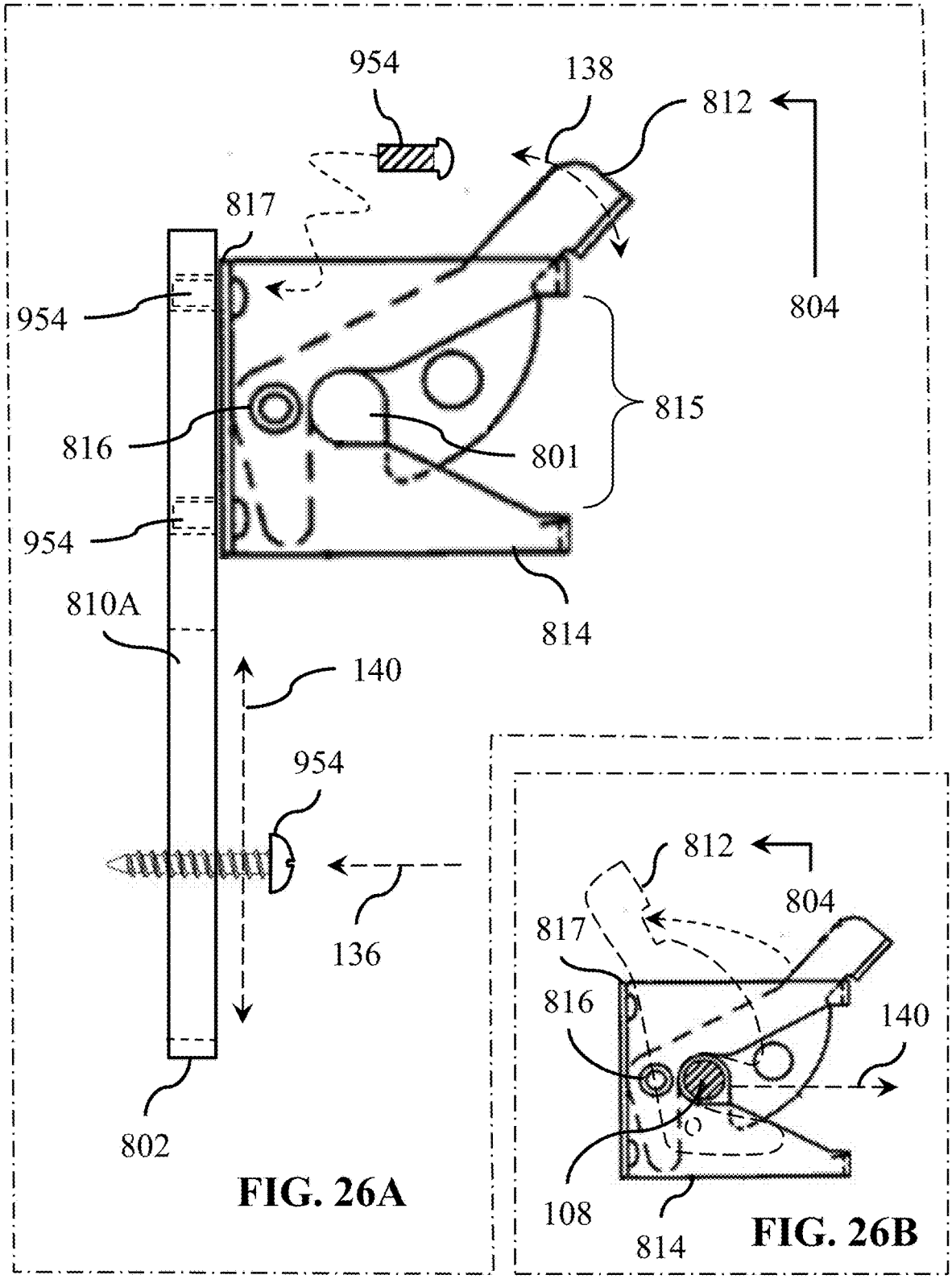
Figure 27:
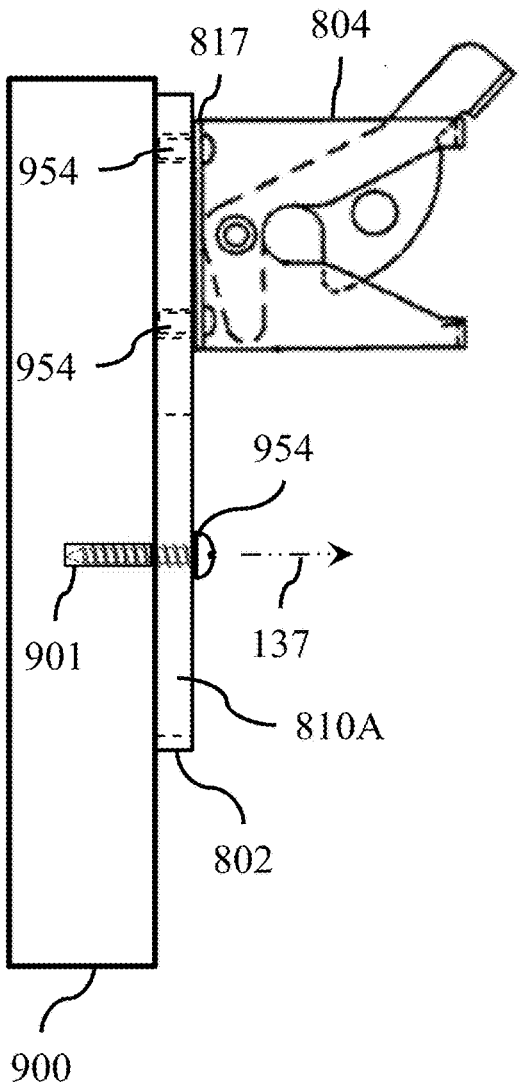
Figure 28:
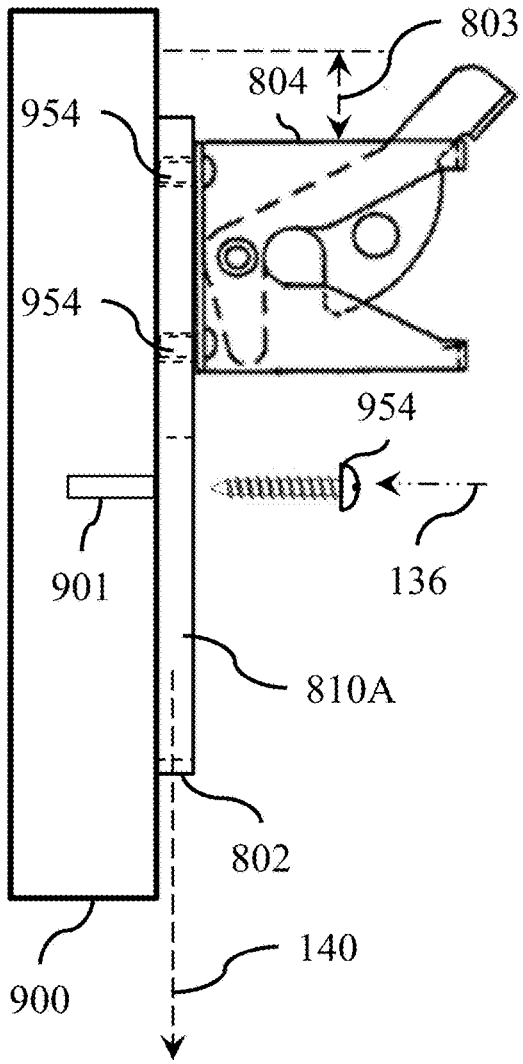
Figure 29:
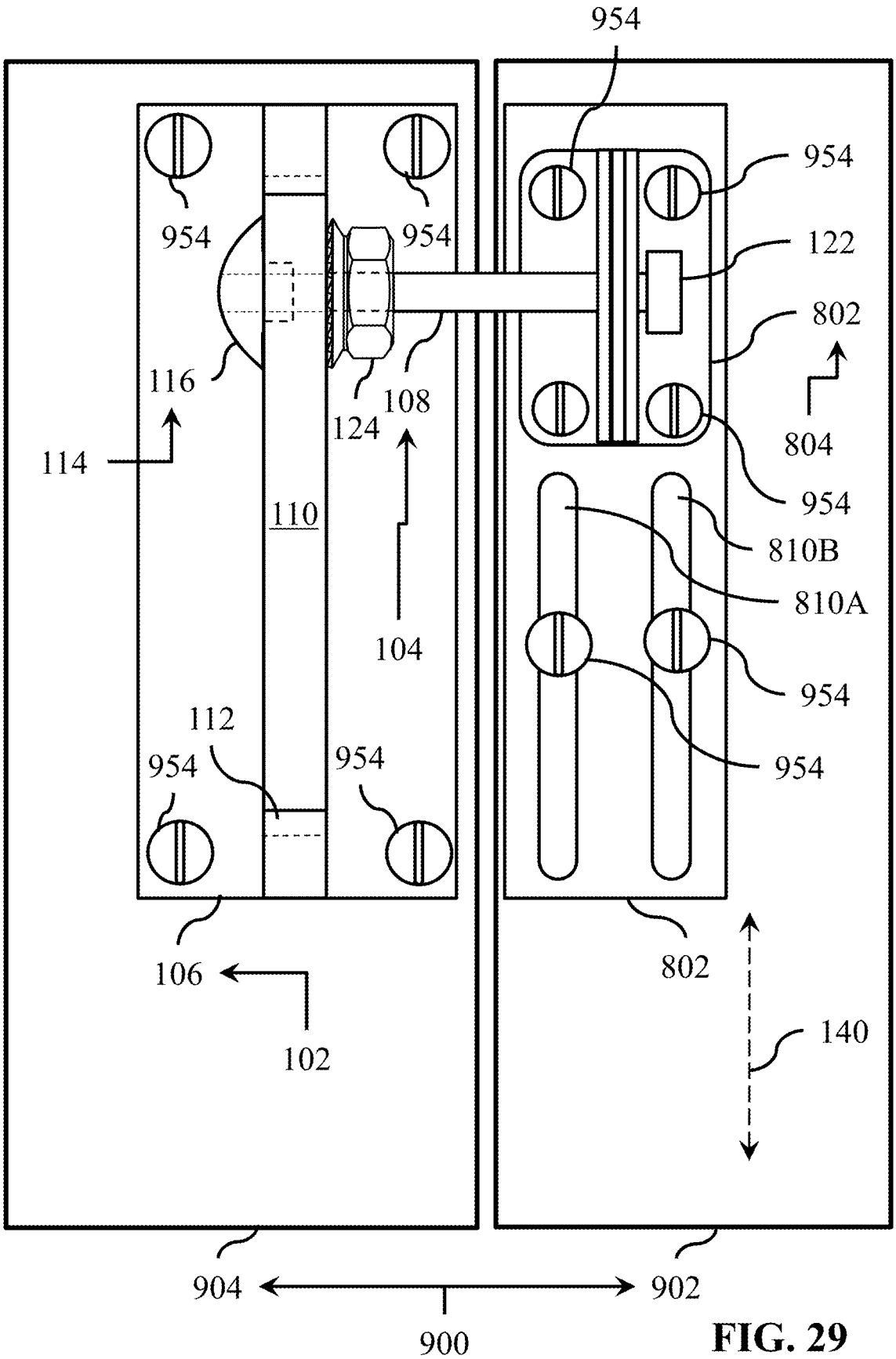
Figure 30:
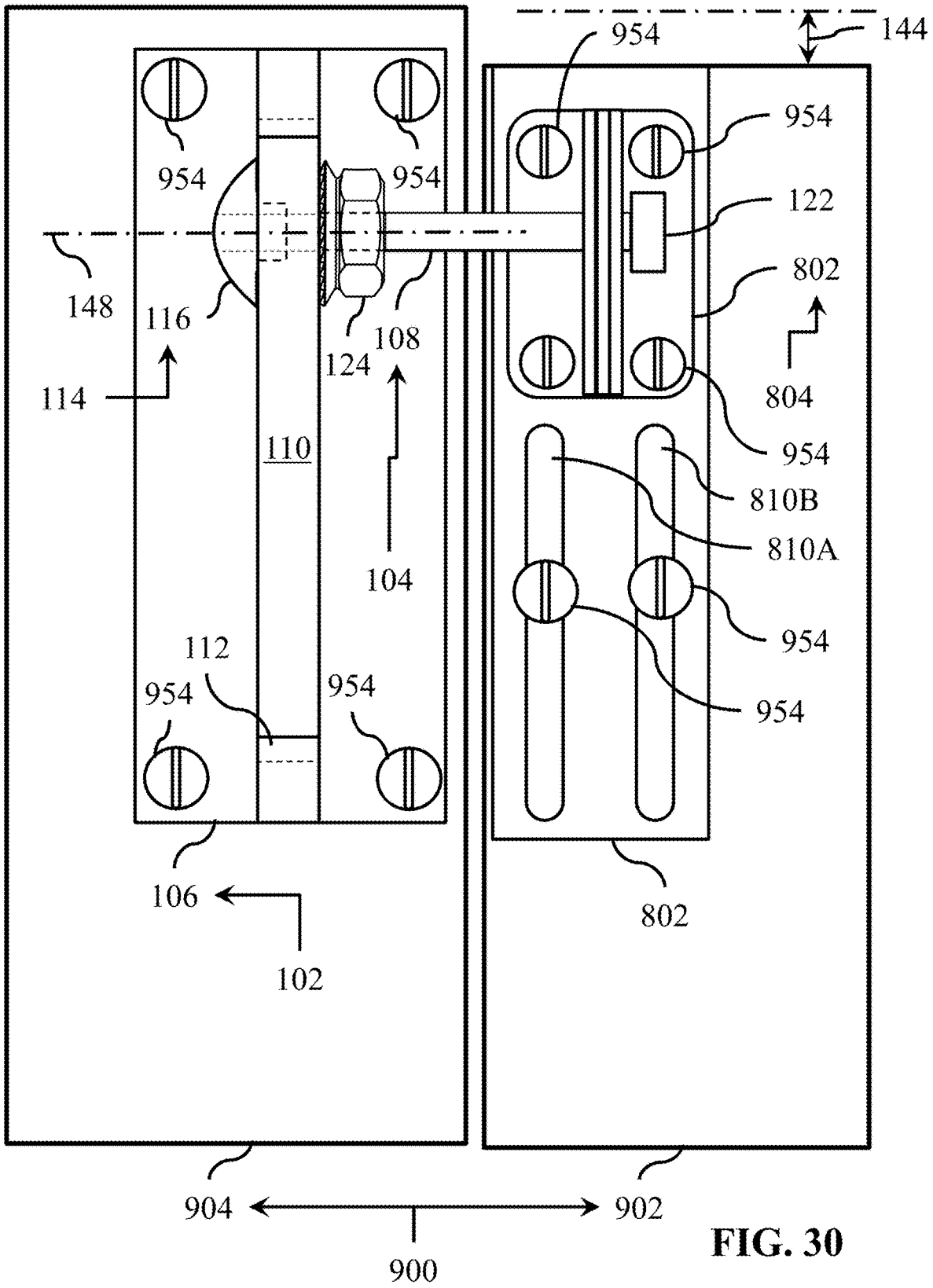
Figure 31:
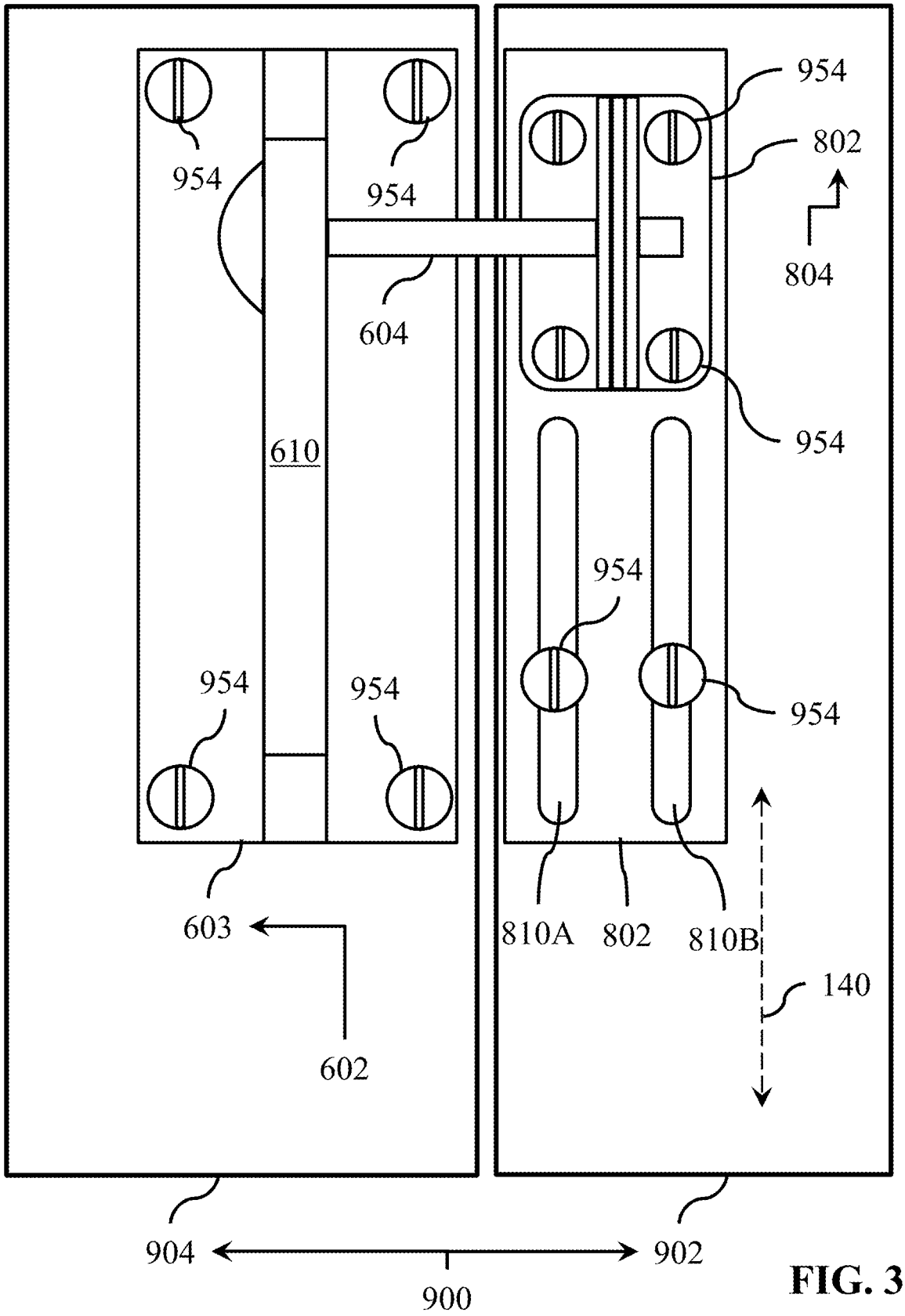

More specifically:

FIG. 1 depicts, in accordance with a first major aspect, a perspective view of an embodiment of a striker base assembly and a striker member; and FIG. 2 to FIG. 9 depict, in accordance with a first major aspect, views of embodiments of the striker member of FIG. 1, in which FIG. 2 depicts a front view, FIG. 3 depicts a side view, FIG. 4 depicts a rear view, FIG. 5 depicts a side view, FIG. 6 depicts an end view, FIG. 7 depicts a side view, FIG. 8 depicts a side view, and FIG. 9 depicts a side perspective view; and FIG. 10 to FIG. 12 depict, in accordance with a first major aspect, views of embodiments of the striker base assembly and the striker member of FIG. 1, in which FIG. 10 depicts a front view, FIG. 11 depicts a lateral side view, and FIG. 12 depicts a top side view; and FIG. 13 and FIG. 14 depict, in accordance with a first major aspect, views of embodiments of the striker base assembly and the striker member of FIG. 1, in which FIG. 13 depicts a side view, and FIG. 14 depicts a lateral side view; and FIG. 15 depicts, in accordance with a first major aspect, a front view of the embodiments of the striker base assembly and the striker member of FIG. 1; and FIG. 16A and FIG. 16B depict, in accordance with a first major aspect, a front view (FIG. 16A) and a side view (FIG. 16B) of embodiments of a latch assembly, the striker base assembly and the striker member of FIG. 1; and FIG. 17 depicts, in accordance with a first major aspect, a front view of the embodiments of the striker base assembly, the striker member, and the latch assembly of FIG. 16A; and FIG. 18 depicts, in accordance with a first major aspect, a front view of the embodiments of the striker base assembly, the striker member, and the latch assembly of FIG. 16A; and FIG. 19 depicts, in accordance with a first major aspect, a front view of the embodiments of the striker base assembly, the striker member, and the latch assembly of FIG. 16A; and FIG. 20 and FIG. 21, in accordance with a first major aspect (and a second major aspect), depict top side views of the embodiments of the striker base assembly and the striker member of FIG. 1; and FIG. 22 and FIG. 23 depict, in accordance with a first major aspect (and a second major aspect), top side views of the embodiments of the striker base assembly and the striker member of FIG. 1; and FIG. 24 and FIG. 25 depict, in accordance with a second major aspect, front views of embodiments of a latch base assembly and a latch assembly; and FIG. 26A and FIG. 26B depict, in accordance with a second major aspect, side views of the embodiments of the latch base assembly and the latch assembly of FIG. 25; and FIG. 27 and FIG. 28 depict, in accordance with a second major aspect, lateral side views of the embodiments of the latch base assembly and the latch assembly of FIG. 25; and FIG. 29 and FIG. 30 depict, in accordance with a second major aspect, front views of the embodiments of the latch base assembly and the latch assembly of FIG. 25; and FIG. 31 depicts, in accordance with a second major aspect, a side view of an embodiment of the latch assembly of FIG. 25.

The drawings are not necessarily to scale and may be illustrated by phantom lines, diagrammatic representations and fragmentary views. In certain instances, details unnecessary for an understanding of the embodiments (and/or details that render other details difficult to perceive) may have been omitted. Corresponding reference characters indicate corresponding components throughout the several figures of the drawings. Elements in the several figures are illustrated for simplicity and clarity and have not been drawn to scale. The dimensions of some of the elements in the figures may be emphasized relative to other elements for facilitating an understanding of the various disclosed embodiments. In addition, common, but well-understood, elements that are useful or necessary in commercially feasible embodiments are often not depicted to provide a less obstructed view of the embodiments of the present disclosure.

LISTING OF REFERENCE NUMERALS USED IN THE DRAWINGS

100 gate-latching assembly
102 striker base assembly
104 striker member
106 striker plate
108 elongated bar
110 extended member
112 guide channel
114 connector assembly
116 head portion
118 channel
120 guide-engagement member
122 end portion
124 nut assembly
126 opening
128 teeth
130 threaded portion
132 hollow striker body
134 mounting channels
136 mounting direction
137 dismounting direction
138 rotation direction
140 movement direction
142 alignment direction
144 vertical drop
146 vertical misalignment distance
148 re-alignment axis
200 post-mount assembly
201 hole
202 mount connector
204 prongs
206 guide
602 base assembly
603 base plate
604 striker part
610 extended part
801 latch receiver
802 latch base assembly
803 vertical height
804 latch assembly
806 mount holes
808 mounting holes
810A first groove
810B second groove
812 movable latch part
814 stationary latch part
815 jaw opening
816 pivot part
817 latch plate
900 gate assembly
901 gate hole
902 stationary gate post
904 movable gate door
950 user
952 tool
954 connecting device
956 mounting assembly
958 nut
960 post

DETAILED DESCRIPTION OF THE NON-LIMITING EMBODIMENT(S)

The following detailed description is merely exemplary and is not intended to limit the described embodiments or the application and uses of the described embodiments. As used, the word "exemplary" or "illustrative" means "serving as an example, instance, or illustration." Any implementation described as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure. The scope of the claim is defined by the claims (in which the claims may be amended during patent examination after the filing of this application). For the description, the terms "upper," "lower," "left," "rear," "right," "front," "vertical," "horizontal," and derivatives thereof shall relate to the examples as oriented in the drawings. There is no intention to be bound by any expressed or implied theory in the preceding Technical Field, Background, Summary or the following detailed description. It is also to be understood that the devices and processes illustrated in the attached drawings, and described in the following specification, are exemplary embodiments (examples), aspects and/or concepts defined in the appended claims. Hence, dimensions and other physical characteristics relating to the embodiments disclosed are not to be considered as limiting, unless the claims expressly state otherwise. It is understood that the phrase "at least one" is equivalent to "a". The aspects (examples, alterations, modifications, options, variations, embodiments and any equivalent thereof) are described regarding the drawings. It should be understood that the invention is limited to the subject matter provided by the claims, and that the invention is not limited to the particular aspects depicted and described. It will be appreciated that the scope of the meaning of a device configured to be coupled to an item (that is, to be connected to, to interact with the item, etc.) is to be interpreted as the device being configured to be coupled to the item, either directly or indirectly. Therefore, "configured to" may include the meaning "either directly or indirectly" unless specifically stated otherwise.

FIG. 1 to FIG. 23 depict, in accordance with a first major aspect, views of embodiments of a striker base assembly 102 and a striker member 104.

FIG. 1 depicts, in accordance with a first major aspect, a perspective view of an embodiment of a striker base assembly 102 and a striker member 104.

Referring to the embodiment as depicted in FIG. 1, an apparatus includes and is not limited to (comprises) a gate-latching assembly 100. The gate-latching assembly 100 is configured for utilization with a gate assembly 900. Embodiments of the gate assembly 900 are depicted in FIG. 17 to FIG. 19. Briefly referring to the embodiments as depicted in FIG. 17 to FIG. 19, the gate assembly 900 includes a stationary gate post 902 configured to be mounted to, and to extend from, a working surface (once the stationary gate post 902 is mounted to the working surface). The gate assembly 900 also includes a movable gate door 904 (or a moveable gate door) configured to be movable (or moveable) relative to the stationary gate post 902.

Referring to the embodiment as depicted in FIG. 1, the gate-latching assembly 100 includes (and is not limited to) a striker base assembly 102. The striker base assembly 102 is configured to be affixed to the gate assembly 900. This is done in such a way that the striker base assembly 102, in use, is spaced apart from a latch assembly 804 (as depicted in the embodiments of FIG. 16A, FIG. 16B, and FIGS. 17 to 19) once the latch assembly 804 is affixed to the gate assembly 900, and once the striker base assembly 102 is affixed to the gate assembly 900. The latch assembly 804 is configured to be affixed to the gate assembly 900.

Referring to the embodiment as depicted in FIG. 1, the gate-latching assembly 100 also includes (and is not limited to) a striker member 104. The striker member 104 is configured to be selectively affixed to the striker base assembly 102. This is done in such a way that the striker member 104, in use, is securely positioned and aligned along a horizontal alignment once the striker base assembly 102 is affixed to the gate assembly 900, and once the striker member 104 is affixed to the striker base assembly 102.

The striker member 104 is also configured to be selectively engageable with, and selectively disengageable from, the latch assembly 804 (once the striker member 104 is affixed to the striker base assembly 102, and once the striker base assembly 102 is affixed to the gate assembly 900, and once the latch assembly 804 is affixed to the gate assembly 900).

The striker member 104 is also configured to be selectively affixed to and selectively disconnected (selectively disconnectable) from a first vertical position located on the striker base assembly 102 (and/or a second vertical position located on the striker base assembly 102).

With reference to FIG. 18 and FIG. 19, the striker member 104 is also configured to be selectively vertically moveable from a first vertical position to a second vertical position. In the first vertical position, the striker member 104 and the latch assembly 804 are misaligned relative to each other as a result of the stationary gate post 902 and the movable gate door 904 becoming misaligned relative to each other. In the second vertical position, the striker member 104 and the latch assembly 804 are aligned relative to each other. This is done in such a way that: (A) the striker member 104, in use, remains horizontally aligned while the striker member 104 is moved from the first vertical position to the second vertical position, and (B) the striker member 104 and the latch assembly 804, in use, are securely latchable with each other in the second vertical position once the stationary gate post 902 and the movable gate door 904 are vertically misaligned relative to each other.

Referring to the embodiment as depicted in FIG. 1, the apparatus is adapted such that the latch assembly 804 is configured to be affixed to a latch base assembly 802. The latch base assembly 802 is configured to be affixed to the gate assembly 900.

Referring to the embodiment as depicted in FIG. 1, the striker base assembly 102 preferably includes a striker plate 106 configured to be connected to the gate assembly 900. The striker member 104 includes an elongated bar 108 (a horizontally-aligned bar). The striker base assembly 102 also includes an extended member 110 configured to extend from the striker plate 106. The striker base assembly 102 is affixed to the extended member 110. The striker base assembly 102 and the extended member 110 are orthogonally aligned relative to each other. The extended member 110 defines (provides) a guide channel 112. A connector assembly 114 is configured to selectively connect the striker member 104 (such as the elongated bar 108) to the extended member 110.

More preferably, the elongated bar 108 is configured to extend from the extended member 110 (once the elongated bar 108 is affixed to the extended member 110). The elongated bar 108 is configured to be received (at least in part) in the guide channel 112. Preferably, the elongated bar 108 is configured to extend through the guide channel 112. The connector assembly 114 is configured to selectively affix (connect) the elongated bar 108 to a location that is positioned on the extended member 110. The elongated bar 108 is configured to be movable (moveable) and relocatable to a selected location that is positioned on the extended member 110 (once the connector assembly 114, in use, selectively disconnects the elongated bar 108 from the extended member 110).

FIG. 2 to FIG. 9 depict, in accordance with a first major aspect, views of embodiments of the striker member 104 of FIG. 1, in which FIG. 2 depicts a front view, FIG. 3 depicts a side view, FIG. 4 depicts a rear view, FIG. 5 depicts a side view, FIG. 6 depicts an end view, FIG. 7 depicts a side view, FIG. 8 depicts a side view, and FIG. 9 depicts a side perspective view.

Referring to the embodiments as depicted in FIG. 2 to FIG. 4, the connector assembly 114 includes a head portion 116. A guide-engagement member 120 extends from one side of the head portion 116. The head portion 116 defines (provides) a channel 118 that extends through the head portion 116 and through the guide-engagement member 120.

Referring to the embodiment as depicted in FIG. 5, the elongated bar 108 includes an end portion 122. The elongated bar 108 forms an elongated cylindrical body with the end portion 122 having a diameter that is larger than the elongated cylindrical body. The connector assembly 114 also includes a nut assembly 124. The nut assembly 124 defines (provides) an opening 126 that extends through the nut assembly 124. The nut assembly 124 includes teeth 128 (a grip feature). The elongated bar 108 includes a threaded portion 130 positioned at an end section of the elongated bar 108.

Referring to the embodiment as depicted in FIG. 6, the end portion 122 has a larger diameter than the elongated bar 108.

Referring to the embodiment as depicted in FIG. 7, the nut assembly 124 includes (defines) the opening 126 that extends through the nut assembly 124. The nut assembly 124 also includes teeth 128 (a gripping portion, and any equivalent thereof).

Referring to the embodiment as depicted in FIG. 8, the elongated bar 108 is inserted into the opening 126 of the nut assembly 124. The threaded portion 130 of the elongated bar 108 is threadably received in the channel 118 (of the head portion 116 and the guide-engagement member 120). The channel 118 provides complementary threads configured to threadably connect with the threaded portion 130 of the elongated bar 108.

Referring to the embodiment as depicted in FIG. 9, there is provided a hollow striker body 132 (such as, a hollow cylinder, etc.). The hollow striker body 132 is configured to receive the elongated bar 108. In some cases, it may be an advantage to provide the hollow striker body 132 for the case where the diameter of the elongated bar 108 may not be sufficiently large.

FIG. 10 to FIG. 12 depict, in accordance with a first major aspect, views of embodiments of the striker base assembly 102 and the striker member 104 of FIG. 1, in which FIG. 10 depicts a front view, FIG. 11 depicts a lateral side view, and FIG. 12 depicts a top side view.

Referring to the embodiment as depicted in FIG. 10, the striker base assembly 102 includes the striker plate 106. Each corner of the striker plate 106 provides (defines) the mounting channels 134. The striker plate 106 provides (defines) mounting channels 134.

Referring to the embodiment as depicted in FIG. 11, the guide channel 112 has an elongated shape with parallel opposite sides. The guide channel 112 is configured to be aligned vertically (once the striker plate 106 is affixed to a gate assembly 900, as depicted in the embodiment of FIG. 17). The guide-engagement member 120 is configured to provide a square-shaped cross-sectional profile. The guide-engagement member 120 is configured to be received in the guide channel 112. The opposite sides of the guide-engagement member 120 are configured to contact (slidably contact) the opposite sides of the guide channel 112. The guide-engagement member 120 and the head portion 116 are configured to slide along a length (vertical length) of the guide channel 112.

Referring to the embodiment as depicted in FIG. 12, the elongated bar 108 is configured to be received (at least in part) in the guide channel 112 of the extended member 110. The extended member 110 is positioned between the head portion 116 and the nut assembly 124 (with the teeth of the nut assembly 124 facing the extended member 110).

FIG. 13 and FIG. 14 depict, in accordance with a first major aspect, views of embodiments of the striker base assembly 102 and the striker member 104 of FIG. 1, in which FIG. 13 depicts a side view, and FIG. 14 depicts a lateral side view.

Referring to the embodiment as depicted in FIG. 13, the nut assembly 124 is rotatable onto the threaded portion 130 of the elongated bar 108 (so that the nut assembly 124 is movable (moveable) along the mounting direction 136). The user 950 rotates the threaded portion 130 onto the threaded portion of the nut assembly 124 defined or positioned on the inner surface surrounding the opening 126 (along a rotation direction 138).

Referring to the embodiment as depicted in FIG. 14, the elongated bar 108 is inserted into the guide channel 112 of the extended member 110 (along a mounting direction 136). The threaded portion 130 extends past the other side of the extended member 110.

FIG. 15 depicts, in accordance with a first major aspect, a front view of the embodiments of the striker base assembly 102 and the striker member 104 of FIG. 1.

Referring to the embodiment as depicted in FIG. 15, the head portion 116 is threadably connected to the threaded portion 130 of the elongated bar 108 (so that the head portion 116 is moved along the mounting direction 136). The user 950 rotates the head portion 116 along the rotation direction 138. Once the head portion 116, in use, is tightened (finger tightened), a tool 952 is utilized to further tighten the nut assembly 124 to improve the grip of the nut assembly 124 against the extended member 110, further clamping down the extended member 110 and the head portion 116 toward each other.

FIG. 16A and FIG. 16B depict, in accordance with a first major aspect, a front view (FIG. 16A) and a side view (FIG. 16B) of embodiments of a latch assembly 804, the striker base assembly 102 and the striker member 104 of FIG. 1.

Referring to the embodiment as depicted in FIG. 16A, the position of the head portion 116 (of the striker member 104) along the extended member 110 may be changed by rotating the nut assembly 124 (along the rotation direction 138), which loosens the head portion 116 and the nut assembly 124 to permit free sliding movement of the head portion 116, the nut assembly 124 and the elongated bar 108 along a movement direction 140 (a vertical direction along a length of the extended member 110). The elongated bar 108 is configured to be aligned with the latch assembly 804 along an alignment direction 142 (once the elongated bar 108 is securely clamped to the extended member 110 that extends from the striker plate 106, and once the striker plate 106 and the latch assembly 804 are mounted or affixed to the gate assembly 900, as depicted in the embodiment of FIG. 17).

Referring to the embodiment as depicted in FIG. 16B, there is depicted an embodiment of the latch assembly 804, for use with the elongated bar 108 as depicted in FIG. 16A. The latch assembly 804 provides (defines) mount holes 806. Side views of embodiments of the latch assembly 804 are depicted in FIG. 16B, FIG. 26A and FIG. 26B.

FIG. 17 depicts, in accordance with a first major aspect, a front view of the embodiments of the striker base assembly 102, the striker member 104, and the latch assembly 804 of FIG. 16A.

Referring to the embodiment as depicted in FIG. 17, a connecting device 954 is inserted into the mounting channels 134 of the striker plate 106. In this manner, the striker plate 106 is mounted or affixed to the gate assembly 900, such as to the movable gate door 904 of the gate assembly 900. A connecting device 954 is inserted into the mount holes 806 of the latch assembly 804. In this manner, the latch assembly 804 is mounted or affixed to the gate assembly 900, such as to the stationary gate post 902 of the gate assembly 900. The elongated bar 108 and the latch assembly 804 are co-aligned with each other along the alignment direction 142.

FIG. 18 depicts, in accordance with a first major aspect, a front view of the embodiments of the striker base assembly 102, the striker member 104, and the latch assembly 804 of FIG. 16A.

FIG. 19 depicts, in accordance with a first major aspect, a front view of the embodiments of the striker base assembly 102, the striker member 104, and the latch assembly 804 of FIG. 16A.

Referring to the embodiment as depicted in FIG. 18, there is depicted the case where the outdoor temperature changes (such as, during the changing of seasons from fall to winter or from winter to spring), and the components of a gate assembly 900 may inadvertently shift as a result of frost heave. More specifically, frost heaving may inadvertently urge unwanted shifting of the components of the gate assembly 900, such as the inadvertent movement of a stationary gate post 902. The stationary gate post 902 is configured to be mounted to, and to extend from, a working surface (the ground). The gate assembly 900 also includes a movable gate door 904. The movable gate door 904 is configured to be movable relative to the stationary gate post 902.

For the case where frost heave inadvertently urges unwanted shifting of the stationary gate post 902, the stationary gate post 902 and the movable gate door 904 become vertically misaligned relative to each other. Moreover, the components of a gate latch device (such as, the combination of the striker member 104 and the latch assembly 804) may not be able to securely latch the stationary gate post 902 and the movable gate door 904 with each other (once the stationary gate post 902 and the movable gate door 904 become vertically misaligned relative to each other, as a result of frost heave acting on the stationary gate post 902).

As a result of frost heave acting on the stationary gate post 902, a vertical drop 144 (also called a vertical height difference) exists between the top of the stationary gate post 902 and the top of the movable gate door 904 (this case results in a vertical misalignment distance 146 between the elongated bar 108 and the latch assembly 804).

Referring to the embodiment as depicted in FIG. 19, to correct for the case (situation) as depicted in FIG. 18, the striker member 104 (such as the elongated bar 108 of the striker member 104) is disconnectable and selectively movable (moveable, relocated) in such a way that the elongated bar 108 and the latch assembly 804 become vertically re-aligned with each other (as depicted in the embodiment of FIG. 19) while the vertical drop 144 exists between the stationary gate post 902 and the movable gate door 904. As depicted in the embodiment of FIG. 19, the vertical misalignment distance 146 between the elongated bar 108 and the latch assembly 804 is reduced (minimized), preferably to zero or near zero vertical misalignment. The elongated bar 108 and the latch assembly 804 are positioned back into re-alignment with each other (along a re-alignment axis 148).

Referring to the embodiments as depicted in FIG. 18 and FIG. 19, the striker member 104 is also configured to be selectively vertically moveable from a first vertical position (as depicted in FIG. 18) to a second vertical position (as depicted in FIG. 19).

In the first vertical position (as depicted in FIG. 18), the striker member 104 and the latch assembly 804 are misaligned relative to each other as a result of the stationary gate post 902 and the movable gate door 904 becoming misaligned relative to each other.

In the second vertical position (as depicted in FIG. 19), the striker member 104 and the latch assembly 804 are aligned relative to each other. This is done in such a way that: (A) the striker member 104, in use, remains horizontally aligned while the striker member 104 is moved from the first vertical position to the second vertical position, and (B) the striker member 104 and the latch assembly 804, in use, are securely latchable with each other in the second vertical position once the stationary gate post 902 and the movable gate door 904 are vertically misaligned relative to each other.

FIG. 20 and FIG. 21 depict, in accordance with a first major aspect (and a second major aspect), top side views of the embodiments of the striker base assembly 102 and the striker member 104 of FIG. 1.

Referring to the embodiments as depicted in FIG. 20 and FIG. 21, the striker plate 106 is configured to be connectable to a post-mount assembly 200. The post-mount assembly 200 is, preferably, C-shaped. A mount connector 202 is configured to affix the post-mount assembly 200 to the rear portion of the striker plate 106. Preferably, the striker plate 106 is welded to the post-mount assembly 200 (the mount connector 202 includes a weld portion). The post-mount assembly 200 is configured to be selectively connectable to a post 960 (a vertical post, in which the post 960 forms a circular cross-sectional profile). The post-mount assembly 200 includes a pair of prongs 204 (extensions), in which the pair of prongs 204 is configured to be spread apart (to permit entrance of the post 960) into the interior of the post-mount assembly 200. The pair of prongs 204 defines a guide 206 configured to receive (at least in part) a mounting assembly 956 (such as a bolt) along the mounting direction 136. The mounting assembly 956 is usable with a nut 958. The mounting assembly 956 is configured to selectively attach (couple) the pair of prongs 204 together (once the mounting assembly 956 is received, at least in part, in the guide 206, and after the post 960 is positioned in the interior of the post-mount assembly 200). The nut 958 is configured to be threadably mounted to a tip portion of the mounting assembly 956. The nut 958 is configured to be selectively rotatable along the rotation direction 138. The post-mount assembly 200 defines (provides) a hole 201. The hole 201 is configured to receive (at least in part) a connecting device 954. The connecting device 954 is configured to affix the post-mount assembly 200 to the post 960 (once the post 960 is received, at least in part, in the interior of the post-mount assembly 200).

FIG. 22 and FIG. 23 depict, in accordance with a first major aspect (and a second major aspect), top side views of the embodiments of the striker base assembly 102 and the striker member 104 of FIG. 1.

Referring to the embodiments as depicted in FIG. 22 and FIG. 23, the striker plate 106 is configured to be connectable to a post-mount assembly 200. The post-mount assembly 200 is, preferably, U-shaped. A mount connector 202 is configured to affix the post-mount assembly 200 to the rear portion of the striker plate 106. Preferably, the striker plate 106 is welded to the post-mount assembly 200 (the mount connector 202 includes a weld portion). The post-mount assembly 200 is configured to be selectively connectable to a post 960 (in which the post 960 forms a square-shaped cross-sectional profile). The post-mount assembly 200 includes a pair of prongs 204 (extensions). The pair of prongs 204 is configured to be spread apart (to permit entrance of the post 960) into the interior of the post-mount assembly 200. The pair of prongs 204 defines a guide 206 configured to receive (at least in part) a mounting assembly 956 (such as a bolt) along the mounting direction 136. The mounting assembly 956 is usable with a nut 958. The mounting assembly 956 is configured to selectively attach (couple) the pair of prongs 204 together (once the mounting assembly 956 is received, at least in part, in the guide 206, and after the post 960 is positioned in the interior of the post-mount assembly 200). The nut 958 is configured to be threadably mounted to a tip portion of the mounting assembly 956. The nut 958 is configured to be selectively rotatable along the rotation direction 138. The post-mount assembly 200 defines (provides) a hole 201. The hole 201 is configured to receive (at least in part) a connecting device 954. The connecting device 954 is configured to affix the post-mount assembly 200 to the post 960 (once the post 960 is received, at least in part, in the interior of the post-mount assembly 200).

FIG. 24 to FIG. 31 depict, in accordance with a second major aspect, views of embodiments of a latch base assembly 802 and a latch assembly 804. It will be appreciated that the embodiment as depicted in FIG. 20 to FIG. 23 are applicable to the second major aspect as depicted in FIG. 24 to FIG. 31.

FIG. 24 and FIG. 25 depict, in accordance with a second major aspect, front views of embodiments of a latch base assembly 802 and a latch assembly 804.

Referring to the embodiments as depicted in FIG. 24 and FIG. 25, an apparatus includes and is not limited to (comprises) a gate-latching assembly 100. The gate-latching assembly 100 is configured for utilization with a gate assembly 900. Embodiments of the gate assembly 900 are depicted in FIG. 17 to FIG. 19. Briefly referring to the embodiments as depicted in FIG. 17 to FIG. 19, the gate assembly 900 includes a stationary gate post 902 configured to be mounted to, and to extend from, a working surface (once the stationary gate post 902 is mounted to the working surface). The gate assembly 900 also includes a movable gate door 904 configured to be movable (moveable) relative to the stationary gate post 902.

Referring to the embodiments as depicted in FIG. 24 and FIG. 25, the gate-latching assembly 100 includes (and is not limited to) a latch base assembly 802. The latch base assembly 802 is configured to be affixed to the gate assembly 900. This is done in such a way that the latch base assembly 802, in use, is spaced apart from a striker base assembly 102 once the striker base assembly 102 is affixed to the gate assembly 900, and once the latch base assembly 802 is affixed to the gate assembly 900. The striker base assembly 102 is configured to be affixed to the gate assembly 900.

A striker member 104 is configured to be affixed to the striker base assembly 102. This is done in such a way that the striker member 104, in use, is securely positioned and aligned along a horizontal alignment once the striker base assembly 102 is affixed to the gate assembly 900, and once the striker member 104 is affixed to the striker base assembly 102.

The gate-latching assembly 100 further includes (and is not limited to) a latch assembly 804. The latch assembly 804 is configured to be affixed to the latch base assembly 802. The latch assembly 804 is also configured to be selectively engageable with, and selectively disengageable from, the striker member 104 once the latch assembly 804 is affixed to the latch base assembly 802, and once the striker base assembly 102 is affixed to the gate assembly 900, and once the latch base assembly 802 is affixed to the gate assembly 900.

The latch assembly 804 is also configured to be selectively affixed to and selectively disconnected (selectively disconnectable) from a first position (one position) located on the latch base assembly 802 and/or a second position (another position) located on the latch base assembly 802.

Referring to the embodiment as depicted in FIG. 24, the latch base assembly 802 provides (defines) mounting holes 808. Preferably, the mounting holes 808 are positioned in an upper section (a first section) of the latch base assembly 802. The latch base assembly 802 defines a pair of spaced-apart grooves, such as a first groove 810A and a second groove 810B. The first groove 810A and the second groove 810B are positioned in a lower section (a second section) of the latch base assembly 802. The first groove 810A and the second groove 810B are spaced apart from each other. The first groove 810A and the second groove 810B are aligned vertically along a vertical length of the latch base assembly 802. The mounting holes 808 are positioned above the first groove 810A and the second groove 810B.

Referring to the embodiment as depicted in FIG. 25, the latch assembly 804 is configured to be mounted to the latch base assembly 802. Preferably, the latch assembly 804 is configured to be mounted to the mounting holes 808 of the latch base assembly 802 by utilization of the connecting device 954 (one for each of the mounting holes 808).

FIG. 26A and FIG. 26B depict, in accordance with a second major aspect, side views of the embodiments of the latch base assembly 802 and the latch assembly 804 of FIG. 25.

Referring to the embodiment as depicted in FIG. 26A and FIG. 26B, the latch assembly 804 includes a movable latch part 812 and a stationary latch part 814. The stationary latch part 814 provides (defines) a jaw opening 815. The jaw opening 815 is configured to receive the elongated bar 108. The movable latch part 812 and the stationary latch part 814 are rotatably mounted to each other at a pivot part 816 (this is done in such a way that the movable latch part 812 is rotatable relative to the stationary latch part 814). The latch assembly 804 defines (provides) a latch receiver 801. The elongated bar 108 is configured to be selectively received (at least in part) in the latch receiver 801. The elongated bar 108 is configured to be selectively removable (removeable) from the latch receiver 801. The jaw opening 815 leads to the latch receiver 801. The stationary latch part 814 extends from (and is affixed to) a latch plate 817. The latch plate 817 of the latch assembly 804 is configured to be affixed to the latch base assembly 802 (by utilization of the connecting device 954). The connecting device 954 is configured to be received (at least in part) in the first groove 810A (or the second groove 810B, as depicted in FIG. 25) along the mounting direction 136. The connecting device 954 is configured to be positioned along a desired portion on the first groove 810A (or the second groove 810B, as depicted in FIG. 25) along a position located along the movement direction 140.

FIG. 27 and FIG. 28 depict, in accordance with a second major aspect, lateral side views of the embodiments of the latch base assembly 802 and the latch assembly 804 of FIG. 25.

Referring to the embodiment as depicted in FIG. 27, the latch assembly 804 is mounted to the gate assembly 900. The connecting device 954 affixes the latch base assembly 802 to the gate assembly 900. The gate assembly 900 defines a gate hole 901 configured to receive the connecting device 954.

Referring to the embodiment as depicted in FIG. 28, the latch base assembly 802 is configured to be disconnectable from the gate hole 901 of the gate assembly 900 (by removal of the connecting device 954 along a dismounting direction 137) so that the latch base assembly 802 is movable (moveable) vertically downward along the movement direction 140 (or vertically upward, as the case may be, or as needed). Once the latch base assembly 802 is relocated, the connecting device 954 is utilized to reattach the latch base assembly 802 to the gate assembly 900. This is done in such a way that the latch assembly 804 is positioned at a different vertical height 803 (when compared to the position of the latch assembly 804, as depicted in FIG. 27).

FIG. 29 and FIG. 30 depict, in accordance with a second major aspect, front views of the embodiments of the latch base assembly 802 and the latch assembly 804 of FIG. 25.

Referring to the embodiment as depicted in FIG. 29, there is depicted the case where the outdoor temperature changes (such as, during the changing of seasons from fall to winter or from winter to spring), and the components of a gate assembly 900 may inadvertently shift as a result of frost heave. More specifically, frost heaving may inadvertently urge unwanted shifting of the components of the gate assembly 900, such as the inadvertent movement of a stationary gate post 902. The stationary gate post 902 is configured to be mounted to, and to extend from, a working surface (the ground). The gate assembly 900 also includes a movable gate door 904. The movable gate door 904 is configured to be movable (moveable) relative to the stationary gate post 902.

Referring to the embodiment as depicted in FIG. 29, for the case where frost heaving inadvertently urges unwanted shifting of the stationary gate post 902, the stationary gate post 902 and the movable gate door 904 become vertically misaligned relative to each other. Moreover, the components of a gate latch device (such as, the combination of the striker member 104 and the latch assembly 804) may not be able to securely latch the stationary gate post 902 and the movable gate door 904 with each other (once the stationary gate post 902 and the movable gate door 904 become vertically misaligned relative to each other, as a result of frost heave acting on the stationary gate post 902).

Referring to the embodiment as depicted in FIG. 30, as a result of frost heave acting on the stationary gate post 902, a vertical drop 144, as depicted in FIG. 30, exists between the top of the stationary gate post 902 and the top of the movable gate door 904 (this case results in a vertical misalignment distance between the elongated bar 108 and the latch base assembly 802, which is not depicted in FIG. 30). To correct for this case (situation), the latch base assembly 802 (of the latch assembly 804) is disconnectable (disconnected) and is selectively movable (relocated as depicted in FIG. 30) in such a way that the latch base assembly 802 and the striker member 104 become vertically re-aligned with each other (as depicted in the embodiment of FIG. 30) while the vertical drop 144 exists between the stationary gate post 902 and the movable gate door 904. The vertical misalignment distance between the elongated bar 108 (of the striker member 104) and the latch base assembly 802 is reduced (minimized), preferably to zero or a near zero vertical misalignment. The latch base assembly 802 and the striker member 104 are positioned back into re-alignment with each other (along a re-alignment axis 148).

Referring to the embodiments as depicted in FIG. 29 and FIG. 30, the latch assembly 804 is also configured to be selectively vertically moveable from a first vertical position (depicted in FIG. 29) and a second vertical position (depicted in FIG. 30).

In the first vertical position (depicted in FIG. 29), the latch assembly 804 and the striker member 104 are misaligned relative to each other as a result of the stationary gate post 902 and the movable gate door 904 becoming misaligned relative to each other.

In the second vertical position (depicted in FIG. 30), the latch assembly 804 and the striker member 104 are aligned relative to each other; this is done in such a way that: (A) the latch assembly 804, in use, remains horizontally aligned while the latch assembly 804 is moved from the first vertical position to the second vertical position, and (B) the latch assembly 804 and the striker member 104, in use, are securely latchable with each other in the second vertical position once the stationary gate post 902 and the movable gate door 904 are vertically misaligned relative to each other.

FIG. 31 depicts, in accordance with a second major aspect, a side view of an embodiment of the latch assembly 804 of FIG. 25.

Referring to the embodiment as depicted in FIG. 31, a base assembly 602 includes a base plate 603 with an extended part 610 configured to extend from the base assembly 602. The extended part 610 may or may not provide (define) a feature that is similar to the guide channel 112 of the extended member 110. A striker part 604 extends from the extended part 610 (along a horizontal direction). The striker part 604 may be affixed to the base plate 603 (or may be disconnectable from the striker part 604 as may be needed or desired).

The following is offered as further description of the embodiments, in which any one or more of any technical feature (described in the detailed description, the summary and the claims) may be combinable with any other one or more of any technical feature (described in the detailed description, the summary and the claims). It is understood that each claim in the claims section is an open-ended claim unless stated otherwise. Unless otherwise specified, relational terms used in these specifications should be construed to include certain tolerances that the person skilled in the art would recognize as providing equivalent functionality. By way of example, the term perpendicular is not necessarily limited to 90.0 degrees, and may include a variation thereof that the person skilled in the art would recognize as providing equivalent functionality for the purposes described for the relevant member or element. Terms such as "about" and "substantially", in the context of configuration, relate generally to disposition, location, or configuration that are either exact or sufficiently close to the location, disposition, or configuration of the relevant element to preserve operability of the element within the invention which does not materially modify the invention. Similarly, unless specifically made clear from its context, numerical values should be construed to include certain tolerances that the person skilled in the art would recognize as having negligible importance as they do not materially change the operability of the invention. It will be appreciated that the description and/or drawings identify and describe embodiments of the apparatus (either explicitly or inherently). The apparatus may include any suitable combination and/or permutation of the technical features as identified in the detailed description, as may be required and/or desired to suit a particular technical purpose and/or technical function. It will be appreciated that, where possible and suitable, any one or more of the technical features of the apparatus may be combined with any other one or more of the technical features of the apparatus (in any combination and/or permutation). It will be appreciated that persons skilled in the art would know that the technical features of each embodiment may be deployed (where possible) in other embodiments even if not expressly stated as such above. It will be appreciated that persons skilled in the art would know that other options would be possible for the configuration of the components of the apparatus to adjust to manufacturing requirements and still remain within the scope as described in at least one or more of the claims. This written description provides embodiments, including the best mode, and also enables the person skilled in the art to make and use the embodiments. The patentable scope may be defined by the claims. The written description and/or drawings may help to understand the scope of the claims. It is believed that all the crucial aspects of the disclosed subject matter have been provided in this document. It is understood, for this document, that the word "includes" is equivalent to the word "comprising" in that both words are used to signify an open-ended listing of assemblies, components, parts, etc. The term "comprising", which is synonymous with the terms "including," "containing," or "characterized by," is inclusive or open-ended and does not exclude additional, un-recited elements or method steps. Comprising (comprised of) is an "open" phrase and allows coverage of technologies that employ additional, un-recited elements. When used in a claim, the word "comprising" is the transitory verb (transitional term) that separates the preamble of the claim from the technical features of the invention. The foregoing has outlined the non-limiting embodiments (examples). The description is made for particular non-limiting embodiments (examples). It is understood that the non-limiting embodiments are merely illustrative as examples.

What is claimed is:

1. An apparatus for use with a gate assembly includes a stationary gate post configured to be mounted to, and extend from, a working surface once the stationary gate post is mounted to the working surface, and in which the gate assembly also includes a moveable gate door configured to be moveable relative to the stationary gate post, the apparatus comprising:

a gate-latching assembly being configured for utilization with the gate assembly; and the gate-latching assembly including:

a striker member being configured to be selectively affixed to a striker base assembly in such a way that the striker member, in use, is securely positioned and aligned along a horizontal alignment once the striker base assembly is affixed to the gate assembly, and once the striker member is affixed to the striker base assembly; and the striker member also being configured to be selectively vertically moveable from a first vertical position, in which the striker member and a latch assembly are misaligned relative to each other as a result of the stationary gate post and the moveable gate door becoming misaligned relative to each other, to a second vertical position, in which the striker member and the latch assembly are aligned relative to each other, in such a way that:

the striker member, in use, remains horizontally aligned while the striker member is moved from the first vertical position to the second vertical position; and the striker member and the latch assembly, in use, are securely latchable with each other in the second vertical position once the stationary gate post and the moveable gate door are vertically misaligned relative to each other; and wherein:

the striker member includes an elongated bar; and the striker base assembly includes a striker plate configured to be connected to the gate assembly; and the striker base assembly also includes an extended member configured to extend from the striker plate; and the extended member provides an elongated guide channel configured to receive the elongated bar; and a connector assembly is configured to selectively connect the elongated bar to the extended member after the elongated bar is received in the elongated guide channel; and the connector assembly includes a nut assembly defining an opening, which extends through the nut assembly, and is configured to receive the elongated bar; and the nut assembly includes teeth surrounding the opening; and the elongated bar includes a threaded portion positioned at an end section of the elongated bar; and the connector assembly includes a head portion having a guide-engagement member extending from one side of the head portion; and the head portion defines a channel extending through the head portion and through the guide-engagement member; and the threaded portion of the elongated bar is threadably received in the channel of the head portion and the guide-engagement member; and the channel provides complementary threads configured to threadably connect with the threaded portion of the elongated bar; and the extended member is configured to be positioned between the head portion and the nut assembly with the teeth of the nut assembly facing the extended member; and the nut assembly is rotatable onto the threaded portion of the elongated bar; and the threaded portion, positioned at the end section of the elongated bar, is rotatable onto the threaded portion of the nut assembly defined on an inner surface surrounding the opening of the nut assembly; and the head portion is threadably connectable to the threaded portion of the elongated bar; and the head portion is rotatable in such a way that the nut assembly abuts against the extended member to clamp down the extended member and the head portion with each other; and the head portion is moveable along the extended member by rotating the nut assembly, which loosens the head portion and the nut assembly to permit free sliding movement of the head portion, the nut assembly and the elongated bar along a length of the extended member; and wherein:

an elongated length of the extended member is fixedly attached along, and extends from, an elongated length of the striker plate; and the elongated guide channel is aligned to extend, at least in part, along an elongated length of the extended member; and the elongated length of the elongated guide channel is aligned parallel to, and spaced apart from, the elongated length of the striker plate; and the elongated bar is configured to be received in, and movable along, the elongated length of the elongated guide channel; and the elongated bar is configured to be alignable with the latch assembly mounted to the stationary gate post after the connector assembly is urged to disconnect the elongated bar from the extended member, and the elongated bar is moved along the elongated length of the elongated guide channel so that the elongated bar is aligned with the latch assembly mounted to the stationary gate post.

2. The apparatus of claim 1, wherein:

the striker base assembly is configured to be affixed to the gate assembly in such a way that the striker base assembly, in use, is spaced apart from the latch assembly once the latch assembly is affixed to the gate assembly, and once the striker base assembly is affixed to the gate assembly, and in which the latch assembly is configured to be affixed to the gate assembly; and the striker member is also configured to be selectively engageable with, and selectively disengageable from, the latch assembly once the striker member is affixed to the striker base assembly, and once the striker base assembly is affixed to the gate assembly, and once the latch assembly is affixed to the gate assembly; and the striker member is also configured to be selectively affixed to, and selectively disconnectable from, the first vertical position located on the striker base assembly and the second vertical position located on the striker base assembly.

3. The apparatus of claim 1, wherein:

the latch assembly is configured to be affixed to a latch base assembly; and the latch base assembly is configured to be affixed to the gate assembly.

4. The apparatus of claim 1, wherein:

the striker plate is configured to be connectable to a post-mount assembly; and a mount connector is configured to affix the post-mount assembly to a rear portion of the striker plate; and the post-mount assembly is configured to be selectively connectable to a post.

5. The apparatus of claim 1, wherein:

the elongated bar is configured to extend from the extended member once the elongated bar is affixed to the extended member.

6. The apparatus of claim 1, wherein:

the connector assembly is configured to selectively affix the elongated bar to a location that is positioned on the extended member.

7. The apparatus of claim 1, wherein:

the elongated bar is configured to be received, at least in part, in the elongated guide channel; and the elongated bar is configured to extend through the elongated guide channel.

8. An apparatus for use with a gate assembly includes a stationary gate post configured to be mounted to, and extend from, a working surface once the stationary gate post is mounted to the working surface, and in which the gate assembly also includes a moveable gate door configured to be moveable relative to the stationary gate post, the apparatus comprising:

a gate-latching assembly being configured for utilization with the gate assembly; and the gate-latching assembly, including:

a latch assembly being configured to be affixed to a latch base assembly; and the latch assembly also configured to be selectively vertically moveable from a first vertical position, in which the latch assembly and a striker member are misaligned relative to each other as a result of the stationary gate post and the moveable gate door becoming misaligned relative to each other, to a second vertical position, in which the latch assembly and the striker member are aligned relative to each other, in such a way that:

the latch assembly, in use, remains horizontally aligned while the latch assembly is moved from the first vertical position to the second vertical position; and the latch assembly and the striker member, in use, are securely latchable with each other in the second vertical position once the stationary gate post and the moveable gate door are vertically misaligned relative to each other; and wherein:

the striker member is configured to be selectively affixed to a striker base assembly in such a way that the striker member, in use, is securely positioned and aligned along a horizontal alignment once the striker base assembly is affixed to the gate assembly, and once the striker member is affixed to the striker base assembly; and wherein:

the striker member includes an elongated bar; and the striker base assembly includes a striker plate configured to be connected to the gate assembly; and the striker base assembly also includes an extended member configured to extend from the striker plate; and the extended member provides an elongated guide channel configured to receive the elongated bar; and a connector assembly is configured to selectively connect the elongated bar to the extended member after the elongated bar is received in the elongated guide channel; and wherein:

the connector assembly includes a nut assembly defining an opening, which extends through the nut assembly, and is configured to receive the elongated bar; and the nut assembly includes teeth surrounding the opening; and wherein:

the elongated bar includes a threaded portion positioned at an end section of the elongated bar; and wherein:

the connector assembly includes a head portion having a guide-engagement member extending from one side of the head portion; and the head portion defines a channel extending through the head portion and through the guide-engagement member; and the threaded portion of the elongated bar is threadably received in the channel of the head portion and the guide-engagement member; and the channel provides complementary threads configured to threadably connect with the threaded portion of the elongated bar; and the extended member is configured to be positioned between the head portion and the nut assembly with the teeth of the nut assembly facing the extended member; and the nut assembly is rotatable onto the threaded portion of the elongated bar; and the threaded portion, positioned at the end section of the elongated bar, is rotatable onto the threaded portion of the nut assembly defined on an inner surface surrounding the opening of the nut assembly; and the head portion is threadably connectable to the threaded portion of the elongated bar; and the head portion is rotatable in such a way that the nut assembly abuts against the extended member to clamp down the extended member and the head portion with each other; and the head portion is moveable along the extended member by rotating the nut assembly, which loosens the head portion and the nut assembly to permit free sliding movement of the head portion, the nut assembly and the elongated bar along a length of the extended member; and wherein:

an elongated length of the extended member is fixedly attached along, and extends from, an elongated length of the striker plate; and the elongated guide channel is aligned to extend, at least in part, along an elongated length of the extended member; and the elongated length of the elongated guide channel is aligned parallel to, and spaced apart from, the elongated length of the striker plate; and the elongated bar is configured to be received in, and movable along, the elongated length of the elongated guide channel; and the elongated bar is configured to be alignable with the latch assembly mounted to the stationary gate post after the connector assembly is urged to disconnect the elongated bar from the extended member, and the elongated bar is moved along the elongated length of the elongated guide channel so that the elongated bar is aligned with the latch assembly mounted to the stationary gate post.

9. The apparatus of claim 8, wherein:

the striker base assembly is configured to be affixed to the gate assembly.

10. The apparatus of claim 8, wherein:

the latch assembly is also configured to be selectively engageable with, and selectively disengageable from, the striker member once the latch assembly is affixed to the latch base assembly, and once the striker base assembly is affixed to the gate assembly, and once the latch base assembly is affixed to the gate assembly.

11. The apparatus of claim 8, wherein:

the latch assembly is also configured to be selectively affixed to and selectively disconnectable from, a first position located on the latch base assembly or a second position located on the latch base assembly.

12. The apparatus of claim 8, wherein:

the striker member is also configured to be selectively vertically moveable from one position, in which the striker member and the latch assembly are misaligned relative to each other as a result of the stationary gate post and the moveable gate door becoming misaligned relative to each other, to another position, in which the striker member and the latch assembly are aligned relative to each other, in such a way that:

the striker member, in use, remains horizontally aligned while the striker member is moved from the first vertical position to the second vertical position; and the striker member and the latch assembly, in use, are securely latchable with each other in the second vertical position once the stationary gate post and the moveable gate door are vertically misaligned relative to each other.

* * * * *